US006582897B2

(12) United States Patent
Yoshioka

(10) Patent No.: US 6,582,897 B2
(45) Date of Patent: Jun. 24, 2003

(54) HEAT DEVELOPABLE LIGHT-SENSITIVE MATERIAL

(75) Inventor: Yasuhiro Yoshioka, Kanagawa (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 09/885,127

(22) Filed: Jun. 21, 2001

(65) Prior Publication Data

US 2002/0018975 A1 Feb. 14, 2002

(30) Foreign Application Priority Data

Jun. 28, 2000 (JP) ..... 2000-195110
Aug. 16, 2000 (JP) ..... 2000-246683

(51) Int. Cl.[7] ..... G03C 1/498

(52) U.S. Cl. ..... 430/619; 430/531; 430/607; 430/610; 430/620; 430/635

(58) Field of Search ..... 430/619, 610, 430/566, 607, 635, 529, 620, 531

(56) References Cited

U.S. PATENT DOCUMENTS 6,146,823 A * 11/2000 Kato ..... 430/619
6,165,707 A * 12/2000 Hirano et al. ..... 430/619
6,174,663 B1 * 1/2001 Kato ..... 430/619

* cited by examiner

*Primary Examiner*—Thorl Chea
(74) *Attorney, Agent, or Firm*—Birch, Stewart, Kolasch & Birch, LLP

(57) ABSTRACT

A heat developable light-sensitive material high in heat development activity, excellent in image keeping quality, high in sensitivity and rapidly developable, comprising a support having provided on one side thereof a light-sensitive silver halide, a light-insensitive organic silver salt, a reducing agent for a silver ion and a binder, wherein the reducing agent is a compound represented by the formula (I), and an aromatic carboxylic acid compound represented by the formula (A) and a hydrogen bonding compound are further provided on the same side where the light-sensitive silver halide is provided.

21 Claims, No Drawings

HEAT DEVELOPABLE LIGHT-SENSITIVE MATERIAL

FIELD OF THE INVENTION

The present invention relates to a heat developable light-sensitive material, and more particularly to a heat developable light-sensitive material high in heat development activity, excellent in image keeping quality, high in sensitivity and rapidly developable.

BACKGROUND OF THE INVENTION

In the recent medical diagnostic film field and photomechanical film field, it has been eagerly desired to reduce the amount of processing waste fluid, from the viewpoint of space saving. Accordingly, techniques relating to heat developable light-sensitive materials have been required as medical diagnostic films and photomechanical films which can be efficiently exposed with a laser image setter or a laser imager and can form black images having high resolution and sharpness. Such heat developable light-sensitive materials can dispense with the use of processing chemicals of the solution system, so that it becomes possible to provide to customers heat development processing systems which are simpler and do not damage the environment.

There is also a similar demand in the field of general image formation materials. However, images for medical diagnosis particularly require fine depictions, so that high image quality excellent in sharpness and graininess is necessary. Moreover, they are characterized by that blue black tone images are preferred from the viewpoint of ease of diagnosis. At present, various kinds of hard copy systems utilizing dyes or pigments, such as ink jet printers and electrophotogarphy, are in circulation as general image formation systems. However, there is no satisfactory system as an output system of medical images.

On the other hand, methods for forming images by heat development utilizing organic silver salts are described, for example, in U.S. Pat. Nos. 3,152,904 and 3,457,075, and D. Klosterboer, *Thermally Processed Silver Systems* (*Image Processes and Materials*), Neblette, the eighth edition, edited by J. Sturge, V. Walworth and A. Shepp, chapter 9, page 279 (1989) Such heat developable light-sensitive materials generally have light-sensitive layers in which reducible silver salts (for example, organic silver salts), catalytic active amounts of photocatalysts (for example, silver halides), reducing agents, and optionally color toning agents for controlling a color tone of silver are dispersed in binder matrixes. After imagewise exposure, the heat developable light-sensitive materials are heated to a high temperature (or example, 80° C. or more) to produce silver through the oxidation-reduction reaction between the reducible silver salts (which act as oxidizing agents) and the reducing agents. The oxidation-reduction reaction is promoted by the catalysis of latent images of silver halides formed by exposure. Silver formed by the reaction of the reducible silver salts in exposed regions becomes black, and is contrasted with unexposed regions to form images. These techniques are disclosed in many literatures including U.S. Pat. No. 2,910,377 and JP-B-43-4924 (the term "JP-B" as used herein means an "examined Japanese patent publication").

In recent years, the heat developable light-sensitive materials have been regarded as important in that they require no processing agents and do not discharge waste materials in large amounts, and have spread widely in the market as excellent systems reduced in a load to the environment. The demand for the heat developable light-sensitive materials has increased therewith, and a further improvement in a development processing amount has been desired. It is necessary therefor to increase the rate of development, so that reducing agents and development accelerators having higher activity have been desired. However, in the heat developable light-sensitive materials, elements necessary for image formation are left even after heat development. Accordingly, an increase in development activity results in deterioration of image keeping quality. It has been therefore a most important problem that heat development activity is allowed to be compatible with image keeping quality.

SUMMARY OF THE INVENTION

It is therefore an object of the present invention to provide a heat developable light-sensitive material high in heat development activity, excellent in image keeping quality, high in sensitivity and rapidly developable.

As a result of intensive studies for solving the above-mentioned problem, the present inventors have discovered that a heat developable light-sensitive material of the invention is high in heat development activity, excellent in image keeping quality, high in sensitivity and rapidly developable, the material comprising a support having provided on one side thereof a light-sensitive silver halide, a light-insensitive organic silver salt, a reducing agent for a silver ion and a binder, wherein the reducing agent is a compound represented by the following formula (I), and an aromatic carboxylic acid compound represented by the following formula (A) and a hydrogen bonding compound are further provided on the same side where the light-sensitive silver halide is provided, (I)

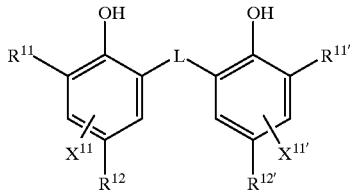

wherein $R^{11}$ and $R^{11'}$ each independently represents an alkyl group; $R^{12}$ and $R^{12'}$ each independently represents a hydrogen atom or a group substitutable to a benzene ring; $X^{11}$ and $X^{11'}$ each independently represents a hydrogen atom or a group substitutable to a benzene ring; $R^{11}$ and $X^{11}$, $R^{11'}$ and $X^{11'}$, $R^{12}$ and X, and $R^{12'}$ and $X^{11'}$ may each combine with each other to form a ring; L represents a —S— group or a —$CHR^{13}$-group; and $R^{13}$ represents a hydrogen atom or an alkyl group, (A)

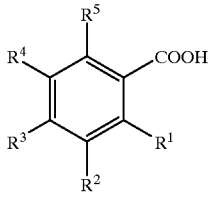

wherein $R^1$, $R^2$, $R^3$, $R^4$ and $R^5$ each independently represents a hydrogen atom or a group substitutable to a benzene ring; and at least one of $R^1$, $R^2$, $R^3$, $R^4$ and $R^5$ represents an undissociative substituent group linked by a carbon atom, a nitrogen atom, an oxygen atom, a sulfur atom or a phosphorus atom to a benzene ring.

The hydrogen bonding compound used in the heat developable light-sensitive material of the invention is preferably a compound represented by the following formula (II):

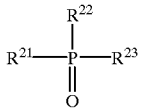

(II)

wherein $R^{21}$, $R^{22}$ and $R^{23}$, which may be unsubstituted or substituted, each independently represents an alkyl group, an aryl group, an alkoxyl group, an aryloxy group, an amino group or a heterocyclic group; and any two of $R^{21}$, $R^{22}$ and $R^{23}$ may combine with each other to form a ring.

In the compound represented by formula (A), preferably used is a compound in which at least one of $R^1$, $R^2$, $R^3$, $R^4$ and $R^5$ is any one of an alkoxyl group, an aryloxy group, an acyloxy group, an alkylsulfonyloxy group, an arylsulfonyloxy group, an acyl group, an alkoxycarbonyl group and aryloxycarbonyl group.

In the compound represented by formula (I) preferably used is a compound in which $R^{11}$ and $R^{11'}$ are each independently a secondary or tertiary alkyl group, $R^{12}$ and $R^{12'}$ are each independently an alkyl group, L is a —S— group or a —$CHR^{13}$ group, wherein $R^{13}$ is a hydrogen atom or an alkyl group, and $X^{11}$ and $X^{11'}$ are both hydrogen atoms; a compound in which $R^{11}$ and $R^{12'}$ are each independently a tertiary alkyl group, $R^{12}$ and $R^{12'}$ are each independently an alkyl group, L is a —S— group or a —$CHR^{13}$ group, wherein $R^{13}$ is an alkyl group; or a compound in which $R^{11}$ and $R^{11}$ are each independently a tertiary alkyl group, $R^{12}$ and $R^{12}$ are each independently an alkyl group having two or more carbon atoms, L is a —S— group or a —$CHR^{13}$ group, wherein $R^{13}$ is a hydrogen atom.

The binder used in the heat developable light-sensitive material of the invention is preferably an aqueous latex, and the average glass transition temperature thereof is preferably from 20° C. to 60° C.

DETAILED DESCRIPTION OF THE INVENTION

The heat developable light-sensitive material of the invention will be described in detail below.

The heat developable light-sensitive material of the invention comprises a support having provided on one side thereof a light-sensitive silver halide, a light-insensitive organic silver salt, a reducing agent for a silver ion and a binder, wherein a development accelerator and a hydrogen bonding compound are further provided on the same side where the light-sensitive silver halide is provided, and the reducing agent is a compound represented by the above-mentioned formula (I).

Such a heat developable light-sensitive material has excellent characteristics of high heat development activity, excellent image keeping quality, high sensitivity and rapid developability.

The reducing agent represented by formula (I) will be described in detail.

In formula (I), $R^{11}$ and $R^{11}$ each independently represents an alkyl group. Specifically, the alkyl group is a substituted or unsubstituted, straight chain, branched or cyclic alkyl group, and preferably an alkyl group having from 1 to 20 carbon atoms. Although there is no particular limitation on a substituent group for the alkyl group, preferred is an aryl group, a hydroxyl group, an alkoxyl group, an aryloxy group, an alkylthio group, an arylthio group, an acylamino group, a sulfonamido group, a sulfonyl group, a phosphoryl group, an acyl group, a carbamoyl group, an ester group or a halogen atom.

More preferably, $R^{11}$ and $R^{11'}$ are each a secondary or tertiary alkyl group having from 3 to 15 carbon atoms, and specifically, an isopropyl group, an isobutyl group, a t-butyl group, a t-amyl group, a t-octyl group, a cyclohexyl group, a cyclopentyl group, a 1-methylcyclohexyl group or a 1-methylcyclopropyl group. More preferred is a tertiary alkyl group having from 4 to 12 carbon atoms, of these, particularly preferred are a t-butyl group, a t-amyl group and a 1-methylcyclohexyl group, and most preferred is a t-butyl group.

$R^{12}$ and $R^{12'}$ each independently represents a group substitutable to a benzene ring. $X^{11}$ and $X^{11'}$ each independently represents a hydrogen atom or a group substitutable to a benzene ring. Preferred examples of the groups substitutable to a benzene ring include an alkyl group, an aryl group, a halogen atom, an alkoxyl group and an acylamino group.

$R^{12}$ and $R^{12'}$ are each preferably an alkyl group having from 1 to 20 carbon atoms, and specifically, a methyl group, an ethyl group, a propyl group, a butyl group, an isopropyl group, a t-butyl group, a t-amyl group, a cyclohexyl group, a 1-methylcyclohexyl group, a benzyl group, a methoxymethyl group or a methoxyethyl group. More preferred is a methyl group, an ethyl group, a propyl group, an isopropyl group or a t-butyl group.

$X^{11}$ and $X^{11'}$ are each preferably a hydrogen atom, a halogen atom or an alkyl group, and particularly preferably a hydrogen atom.

$R^{11}$ and $X^{11}$, $R^{11'}$ and $X^{11'}$, $R^{12}$ $X^{11}$, and $R^{12'}$ and $X^{11'}$ may each combine with each other to form a ring. The ring is preferably a 5-, 6- or 7-membered ring, and more preferably a saturated 6-membered ring.

L represents a —S— group or a —$CHR^{13}$— group, and $R^{13}$ represents a hydrogen atom or an alkyl group. Specifically, $R^{13}$ is a substituted or unsubstituted, straight chain, branched or cyclic alkyl group, and preferably an alkyl group having from 1 to 20 carbon atoms. Specific examples of the unsubstituted alkyl groups represented by $R^{13}$ include a methyl group, an ethyl group, a propyl group, a butyl group, a heptyl group an undecyl group, an isopropyl group, a 1-ethylpentyl group and 2,4,4-trimethylpentyl group. Substituent groups for the substituted alkyl groups represented by $R^{13}$ are the same as the substituent groups for the alkyl groups represented by $R^{11}$ and $R^{11'}$.

L is preferably a —$CHR^{13}$— group. $R^{13}$ is preferably a hydrogen atom or an alkyl group having from 1 to 15 carbon atoms. The alkyl group is preferably a primary or secondary alkyl group having from 1 to 8 carbon atoms, more preferably a methyl group, an ethyl group, an n-propyl group, an isopropyl group or a 2,4,4-trimethylpentyl group, still more preferably a methyl group, an ethyl group, an n-propyl group or an isopropyl group, and particularly preferably a methyl group, an ethyl group or an n-propyl group.

When $R^{13}$ is a hydrogen atom, $R^{12}$ and $R^{12'}$ are each preferably an alkyl group having 2 or more carbon atoms, more preferably an alkyl group having from 2 to 5 carbon atoms, still more preferably from an ethyl group or a propyl group, and most preferably an ethyl group.

When $R^{13}$ is an alkyl group, $R^{12}$ and $R^{12'}$ are each preferably an alkyl group, and particularly preferably a methyl group.

Specific examples of the compounds represented by formula (I) are shown below, but the compounds which can be used in the invention are not limited thereto.

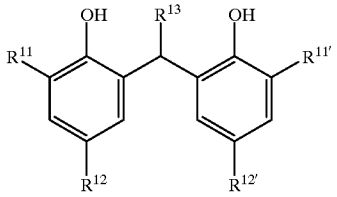

| | $R^{11}$ | $R^{11'}$ | $R^{12}$ | $R^{12'}$ | $R^{13}$ |
|---|---|---|---|---|---|
| I-1 | $CH_3$ | $CH_3$ | $CH_3$ | $CH_3$ | H |
| I-2 | $CH_3$ | $CH_3$ | $CH_3$ | $CH_3$ | $CH_3$ |
| I-3 | $CH_3$ | $CH_3$ | $CH_3$ | $CH_3$ | $C_3H_7$ |
| I-4 | $CH_3$ | $CH_3$ | $CH_3$ | $CH_3$ | i-$C_3H_7$ |
| I-5 | $CH_3$ | $CH_3$ | $CH_3$ | $CH_3$ | $CH(C_2H_5)C_4H_9$ |
| I-6 | $CH_3$ | $CH_3$ | $CH_3$ | $CH_3$ | $CH_2CH(CH_3)CH_2C(CH_3)_3$ |
| I-7 | $CH_3$ | $CH_3$ | $C_2H_5$ | $C_2H_5$ | H |
| I-8 | $CH_3$ | $CH_3$ | $C_2H_5$ | $C_2H_5$ | i-$C_3H_7$ |
| I-9 | $C_2H_5$ | $C_2H_5$ | $CH_3$ | $CH_3$ | H |
| I-10 | $C_2H_5$ | $C_2H_5$ | $CH_3$ | $CH_3$ | i-$C_3H_7$ |
| I-11 | t-$C_4H_9$ | t-$C_4H_9$ | $CH_3$ | $CH_3$ | H |
| I-12 | t-$C_4H_9$ | t-$C_4H_9$ | $CH_3$ | $CH_3$ | $CH_3$ |
| I-13 | t-$C_4H_9$ | t-$C_4H_9$ | $CH_3$ | $CH_3$ | $C_2H_5$ |
| I-14 | t-$C_4H_9$ | t-$C_4H_9$ | $CH_3$ | $CH_3$ | n-$C_3H_7$ |
| I-15 | t-$C_4H_9$ | t-$C_4H_9$ | $CH_3$ | $CH_3$ | n-$C_4H_9$ |
| I-16 | t-$C_4H_9$ | t-$C_4H_9$ | $CH_3$ | $CH_3$ | n-$C_7H_{15}$ |
| I-17 | t-$C_4H_9$ | t-$C_4H_9$ | $CH_3$ | $CH_3$ | n-$C_{11}H_{21}$ |
| I-18 | t-$C_4H_9$ | t-$C_4H_9$ | $CH_3$ | $CH_3$ | i-$C_3H_7$ |
| I-19 | t-$C_4H_9$ | t-$C_4H_9$ | $CH_3$ | $CH_3$ | $CH(C_2H_5)C_4H_9$ |
| I-20 | t-$C_4H_9$ | t-$C_4H_9$ | $CH_3$ | $CH_3$ | $CH_2CH(CH_3)_2$ |
| I-21 | t-$C_4H_9$ | t-$C_4H_9$ | $CH_3$ | $CH_3$ | $CH_2CH(CH_3)CH_2C(CH_3)_3$ |
| I-22 | t-$C_4H_9$ | t-$C_4H_9$ | $CH_3$ | $CH_3$ | $CH_2OCH_3$ |
| I-23 | t-$C_4H_9$ | t-$C_4H_9$ | $CH_3$ | $CH_3$ | $CH_2CH_2OCH_3$ |
| I-24 | t-$C_4H_9$ | t-$C_4H_9$ | $CH_3$ | $CH_3$ | $CH_2CH_2OC_4H_9$ |
| I-25 | t-$C_4H_9$ | t-$C_4H_9$ | $CH_3$ | $CH_3$ | $CH_2CH_2SC_{12}H_{25}$ |
| I-26 | t-$C_4H_9$ | t-$C_4H_9$ | $C_2H_5$ | $C_2H_5$ | H |
| I-27 | t-$C_4H_9$ | t-$C_4H_9$ | $C_2H_5$ | $C_2H_5$ | $CH_3$ |
| I-28 | t-$C_4H_9$ | t-$C_4H_9$ | $C_2H_5$ | $C_2H_5$ | n-$C_3H_7$ |
| I-29 | t-$C_4H_9$ | t-$C_4H_9$ | $C_2H_5$ | $C_2H_5$ | i-$C_3H_7$ |
| I-30 | t-$C_4H_9$ | t-$C_4H_9$ | $C_2H_5$ | $C_2H_5$ | $CH_2CH_2OCH_3$ |
| I-31 | t-$C_4H_9$ | t-$C_4H_9$ | n-$C_3H_7$ | n-$C_3H_7$ | H |
| I-32 | t-$C_4H_9$ | t-$C_4H_9$ | n-$C_3H_7$ | n-$C_3H_7$ | $CH_3$ |
| I-33 | t-$C_4H_9$ | t-$C_4H_9$ | n-$C_3H_7$ | n-$C_3H_7$ | n-$C_3H_7$ |
| I-34 | t-$C_4H_9$ | t-$C_4H_9$ | n-$C_4H_9$ | n-$C_4H_9$ | H |
| I-35 | t-$C_4H_9$ | t-$C_4H_9$ | n-$C_4H_9$ | n-$C_4H_9$ | $CH_3$ |
| I-36 | t-$C_5H_{11}$ | t-$C_5H_{11}$ | $CH_3$ | $CH_3$ | H |
| I-37 | t-$C_5H_{11}$ | t-$C_5H_{11}$ | $CH_3$ | $CH_3$ | $CH_3$ |
| I-38 | t-$C_5H_{11}$ | t-$C_5H_{11}$ | $C_2H_5$ | $C_2H_5$ | H |
| I-39 | t-$C_5H_{11}$ | t-$C_5H_{11}$ | $C_2H_5$ | $C_2H_5$ | $CH_3$ |
| I-40 | i-$C_3H_7$ | i-$C_3H_7$ | $CH_3$ | $CH_3$ | H |
| I-41 | i-$C_3H_7$ | i-$C_3H_7$ | $CH_3$ | $CH_3$ | n-$C_3H_7$ |
| I-42 | i-$C_3H_7$ | i-$C_3H_7$ | $C_2H_5$ | $C_2H_5$ | H |
| I-43 | i-$C_3H_7$ | i-$C_3H_7$ | $C_2H_5$ | $C_2H_5$ | n-$C_3H_7$ |
| I-44 | i-$C_3H_7$ | i-$C_3H_7$ | i-$C_3H_7$ | i-$C_3H_7$ | H |
| I-45 | i-$C_3H_7$ | i-$C_3H_7$ | i-$C_3H_7$ | i-$C_3H_7$ | $CH_3$ |
| I-46 | i-$C_4H_9$ | $CH_3$ | $CH_3$ | $CH_3$ | H |
| I-47 | i-$C_4H_9$ | $CH_3$ | $CH_3$ | $CH_3$ | $CH_3$ |
| I-48 | i-$C_4H_9$ | $CH_3$ | $CH_3$ | $CH_3$ | n-$C_3H_7$ |
| I-49 | i-$C_4H_9$ | $CH_3$ | t-$C_4H_9$ | $CH_3$ | $CH_3$ |
| I-50 | i-$C_3H_7$ | $CH_3$ | $CH_3$ | $CH_3$ | $CH_3$ |

51

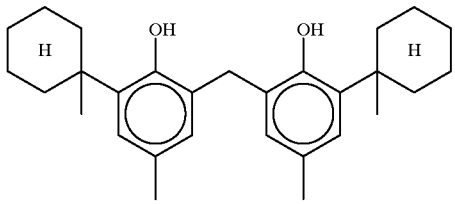

-continued

52

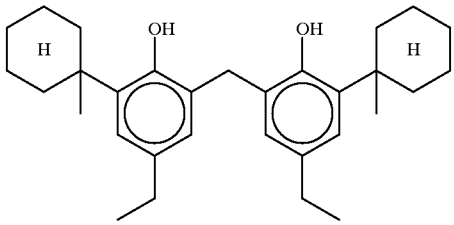

53

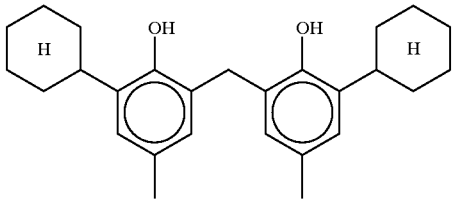

54

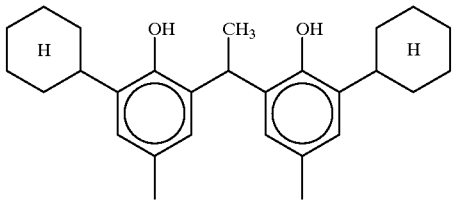

55

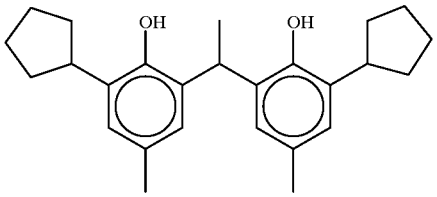

56

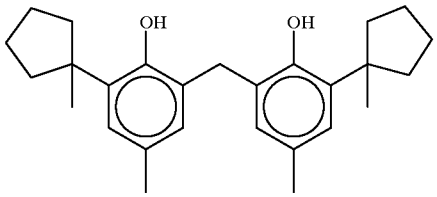

57

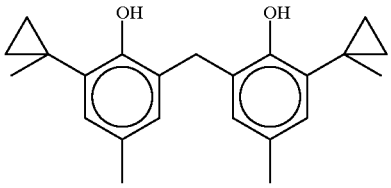

58

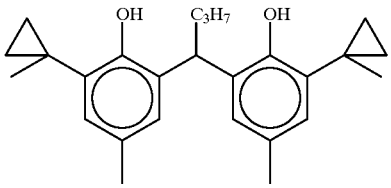

-continued
59
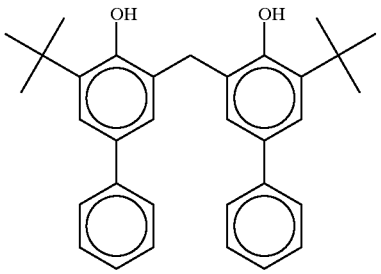
60
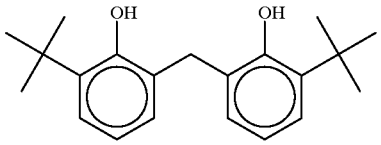
61
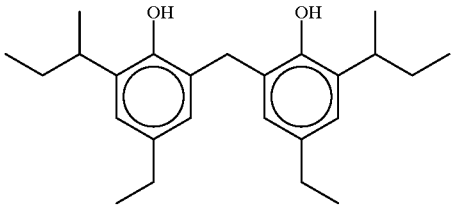
62
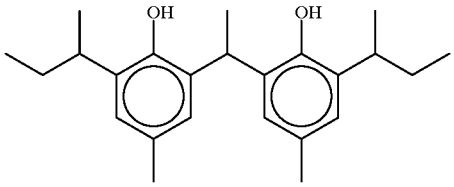
63
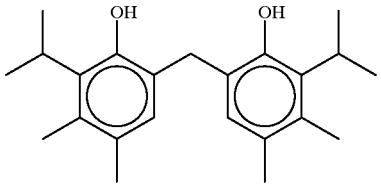
64
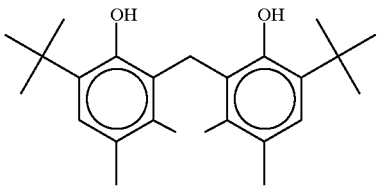
65
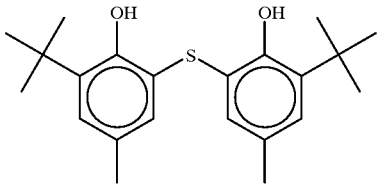
-continued
66
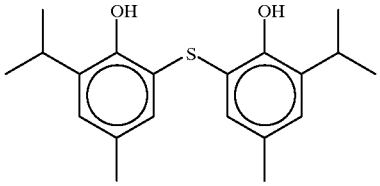
67
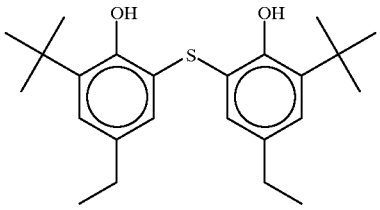
68
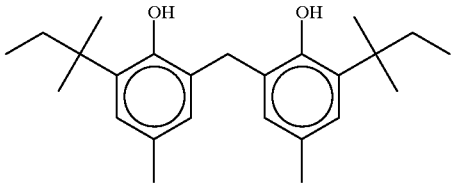
69
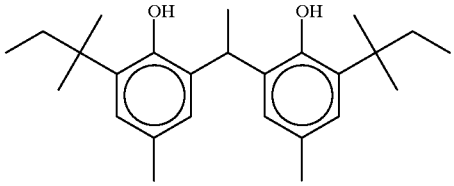
70
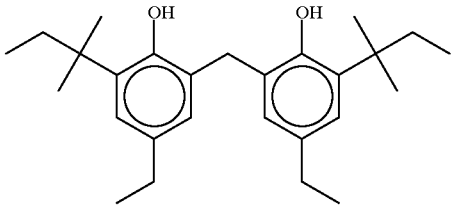
71
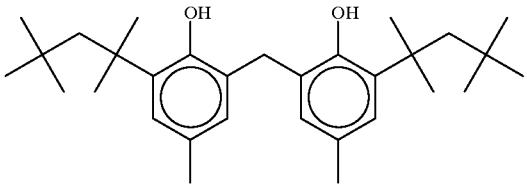
72
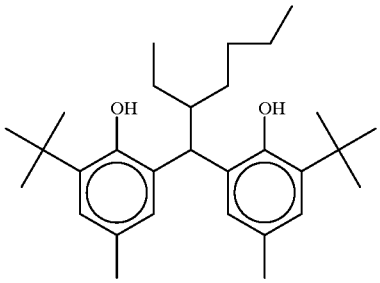

-continued

73

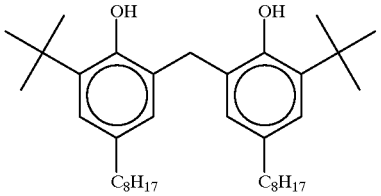

74

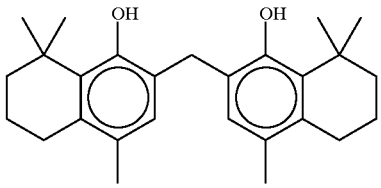

75

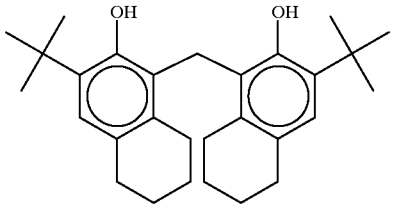

76

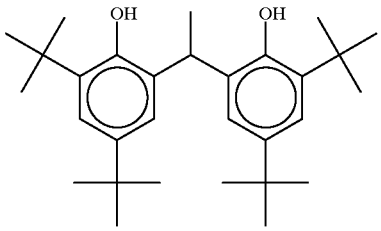

In the invention, the amount of the reducing agent represented by formula (I) added is preferably from 0.01 to 5.0 g/m$^2$, and more preferably from 0.1 to 3. 0 g/m$^2$. The reducing agent is contained preferably in an amount of 5 to 50 mol %, and more preferably in an amount of 10 to 40 mol %, based on mol of silver on a side having the light-sensitive silver halide. It is preferred that the reducing agent is contained in an image formation layer.

The reducing agents may be added to coating solutions in any forms such as the form of solutions, the form of emulsified dispersions and the form of fine solid particle dispersions, thereby allowing them to be contained in the light-sensitive materials.

The well-known emulsified dispersion methods include a method of dissolving the reducing agents using oils such as dibutyl phthalate, tricresyl phosphate, glyceryl triacetate and diethyl phthalate, and co-solvents such as ethyl acetate and cyclohexanone, and mechanically preparing emulsified dispersions.

Further, the fine solid particle dispersion methods include a method of dispersing reducing agent powders in appropriate solvents such as water in a ball mill, a colloid mill, a vibrating ball mill, a sand mill, a jet mill or a roller mill, or by a supersonic wave to prepare solid dispersions In that case, protective colloids (e.g., polyvinyl alcohol) and surfactants (e.g., anionic surfactants such as sodium triisopropylnaphthalenesulfonate (a mixture of three isomers different in substitution positions of isopropyl groups)) may be used. The aqueous dispersions may contain preservatives (e.g., benzoisothiazolinone sodium salt).

In the heat developable light-sensitive material of the invention, the above-mentioned compound represented by formula (A) is further used on the same side where the light-sensitive silver halide is provided.

In formula (A), $R^1$, $R^2$, $R^3$, $R^4$ and $R^5$ each independently represents a hydrogen atom or a group substitutable to a benzene ring.

At least one of $R^1$, $R^2$, $R^3$, $R^4$ and $R^5$ represents an undissociative substituent group linked by a carbon atom, a nitrogen atom, an oxygen atom, a sulfur atom or a phosphorus atom to a benzene ring.

The groups linked by carbon atoms include, for example, a straight chain, branched or cyclic alkyl group, an alkenyl group, an alkynyl group, an aryl group, an acyl group, an alkoxycarbonyl group, an aryloxycarbonyl group, a carbamoyl group, a cyano group, a heterocyclic group, a sulfonylcarbamoyl group, an acylcarbamoyl group, a sulfamoylcarbamoyl group, a carbazoyl group, an oxalyl group, an oxamoyl group and a thiocarbamoyl group.

The substituent groups linked by oxygen atoms include, for example, an alkoxyl group, an aryloxy group, a heterocyclic oxy group, an acyloxy group, an (alkoxyl or aryloxy) carbonyloxy group, a carbamoyloxy group, a sulfonyloxy group and phosphonyloxy group.

The substituent groups linked by nitrogen atoms include, for example, an amino group, a nitro group, a hydrazino group, a heterocyclic group, an acylamino group, an (alkoxyl or aryloxy)carbonylamino group, a sulfonylamino group, a sulfamoylamino group, a semicarbazido group, an oxamoylamino group, a ureido group, a thioureido group, a sulfonylureido group, an acylureido group, an acylsulfamoylamino group, a phosphorylamino group and an imido group.

The substituent groups linked by sulfur atoms include, for example, an alkylthio group, an arylthio group, a disulfido group, a sulfonyl group, a sulfinyl group, a sulfamoyl group, an acylsulfamoyl group and a heterocyclic thio group.

The substituent groups linked by phosphorus atoms include, for example, a phosphonyl group and a phosphinyl group.

The groups substitutable to a benzene ring other than the above, which are represented by $R^1$, $R^2$, $R^3$, $R^4$ and $R^5$, include, for example, a halogen atom.

The groups represented by $R^1$, $R^2$, $R^3$, $R^4$ and $R^5$ may be further substituted by the above-mentioned substituent groups.

The compound represented by formula (A) is characterized by that it has only one carboxyl group in its molecule for imparting proper acidity and hydrophilicity. In addition to this carboxyl group, the compound does not have a strong dissociative group giving a pKa of 6 or less as a substituent group.

At least one of the groups represented by $R^1$, $R^2$, $R^3$, $R^4$ and $R^5$ is a group selected from an alkyl group having from 1 to 30 carbon atoms (e.g., methyl, ethyl, isopropyl, butyl, cyclohexyl, n-octyl, 3,5,5-trimethylhexyl, n-dodecyl), an aryl group having from 6 to 30 carbon atoms (e.g., phenyl, naphthyl, tolyl, xylyl, 3,5-dichlorophenyl), a heterocyclic group having from 5 to 30 carbon atoms (e.g., pyridyl, quinolyl, piperidyl, pyrimidyl), an alkoxyl group having from 1 to 30 carbon atoms (e.g., methoxy, propoxy, butoxy, methoxyethoxy, dodecyloxy, 2-ethylhexyloxy), an aryloxy group having from 6 to 30 carbon atoms (e.g., phenoxy, 1-naphthoxy, cresyl, 3-chlorophenoxy, 4-tert-octylphenoxy), a sulfonyloxy group having from 1 to 30 carbon atoms (e.g., methanesulfonyloxy, butanesulfonyloxy, benzenesulfonyloxy, 4-methylbenzenesulfonyloxy), an acyl group having from 2 to 30 carbon atoms (e.g., acetyl, pivaloyl, benzoyl, 4-chlorobenzoyl, 3,5-dimethylbenzoyl), an acyloxy group having from 2 to 30 carbon atoms (e-g., acetyloxy, benzoyloxy, pivaloyloxy, 3-methylbenzoyloxy, 4-methoxybenzoyloxy, 2-chlorobenzoyloxy), an alkoxycarbonyl group having from 2 to 30 carbon atoms (e.g., methoxycarbonyl, ethoxycarbonyl, hexyloxycarbonyl, dodecyloxycarbonyl), an aryloxycarobnyl group having from 2 to 30 carbon atoms (e.g., phenoxycarbonyl, benzoyloxycarbonyl, 3,4-dichlorophenyloxycarbonyl), an acylamino group having from 1 to 30 carbon atoms (e.g., acetylamino, benzoylamino, N,N-dimethylcarbamoylamino), a sulfonylamino group having from 1 to 30 carbon atoms (e.g., methanesulfonylamino, benzenesulfonylamino, p-toluenesulfonylamino), a carbamoyl group having from 1 to 30 carbon atoms (e.g., dimethylcarbamoyl, diethylcarbamoyl, dibutylcarbamoyl, octylcarbamoyl, phenylcarbamoyl, N-methylphenylcarbamoyl), a sulfamoyl group having from 1 to 30 carbon atoms (e.g., dimethylsulfamoyl, octylsulfamoyl, phenylsulfamoyl) and a sulfonyl group having from 1 to 30 carbon atoms (e.g., methanesulfonyl, octanesulfonyl, dodecanesulfonyl, benzenesulfonyl, toluenesulfonyl, xylenesulfonyl).

Of these, it is particularly preferred that at least one of $R^1$, $R^2$, $R^3$, $R^4$ and $R^5$ is any one of an alkoxyl group, an aryloxy group, an acyloxy group, an alkylsulfonyloxy group, an arylsulfonyloxy group, an acyl group, an alkoxycarbonyl group and an aryloxycarbonyl group.

Although the above-mentioned substituent group may be substituted at any one of the positions ortho, meta and para to the carboxyl group, the ortho or para position is preferred, and the ortho position is more preferred.

As substituent groups other than the above for $R^1$, $R^2$ $R^3$, $R^4$ and $R^5$, preferred are a halogen atom and an alkyl group, and particularly preferred are a chlorine atom and a methyl group.

The compounds represented by formula (A) can be easily synthesized by known methods. Further, although the compounds represented by formula (A) may be added to any layers on the image formation layer side to the support, that is to say, the image formation layer or any other layers on this layer side, it is preferred that the compound are added to the image formation layer or the layer adjacent thereto.

The compounds represented by formula (A) can be added to the heat developable light-sensitive materials in any forms such as the form of solutions, the form of emulsified dispersions and the form of solid particle dispersions, similarly to the reducing agents. The compound represented by formula (A) is preferably added in an amount of 0.1 to 100 mol % based on the reducing agent. The amount of the compound added is more preferably from 0.5 to 50 mol %, and more preferably from 1 to 30 mol %, based on the reducing agent.

Specific examples of the compounds represented by formula (A) are shown below, but compounds which can be used in the invention are not limited thereto.

A-1

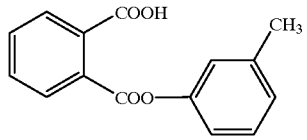

A-2

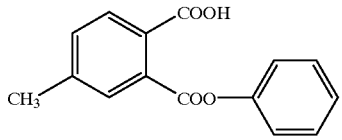

A-3

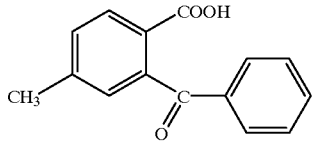

A-4

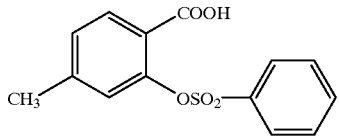

A-5

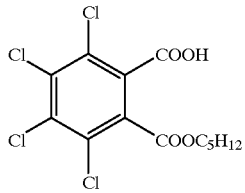

A-6

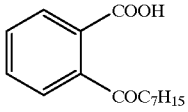

A-7

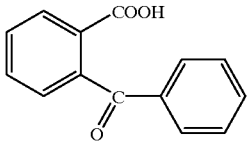

A-8

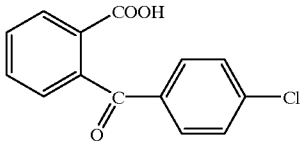

A-9

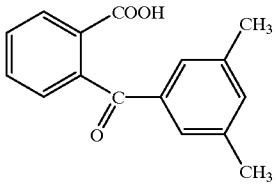

A-10

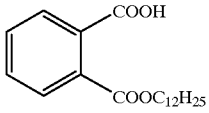

-continued

A-11

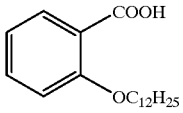

A-12

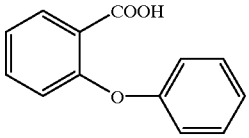

A-13

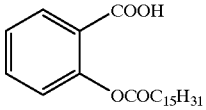

A-14

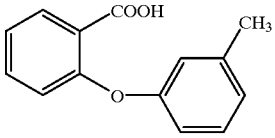

A-15

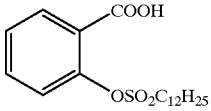

A-16

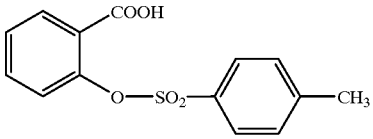

A-17

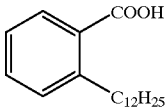

A-18

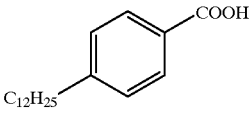

A-19

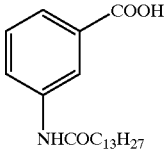

A-20

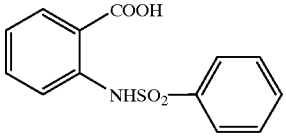

-continued

A-21

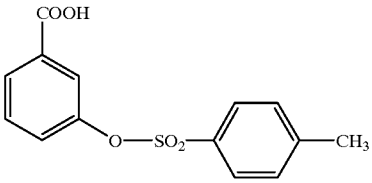

A-22

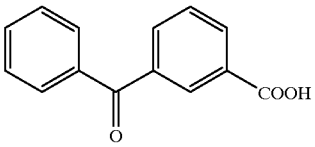

A-23

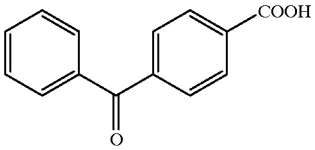

A-24

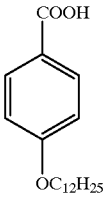

A-25

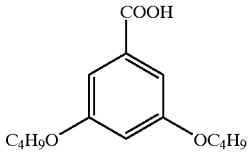

A-26

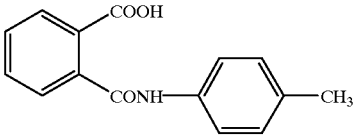

A-27

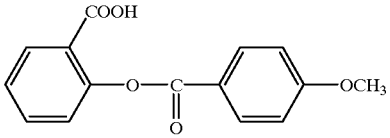

The heat developable light-sensitive material of the invention further has the hydrogen bonding compound on the same side where the light-sensitive silver halide is provided. The hydrogen bonding compound used in the invention is a nonreducing compound having a group which can form a hydrogen bond with a hydroxyl group of the compound represented by formula (I).

The groups each of which can form a hydrogen bond with a hydroxyl group include a phosphoryl group, a sulfoxido group, a sulfonyl group, a carbonyl group, an amido group, an ester group, a urethane group, a ureido group, a tertiary amino group and a nitrogen-containing aromatic group. Of these, preferred are a phosphoryl group, a sulfoxido group, an amido group (having no >N—H group and blocked as >N—R (wherein R is a group other than E)), a urethane group (having no >N—H group and blocked as >N—R (wherein R is a group other than H)) and a ureido group (having no >N—H group and blocked as >N—R (wherein R is a group other than H)).

In the invention, as the hydrogen bonding compound, there is preferably used the compound represented by the above-mentioned formula (II).

In formula (II) $R^{21}$, $R^{22}$ and $R^{23}$, which may be unsubstituted or substituted, each independently represents an alkyl group, an aryl group, an alkoxyl group, an aryloxy group, an amino group or a heterocyclic group, and any two of $R^{21}$, $R^{22}$ and $R^{23}$ may combine with each other to form a ring.

When $R^{21}$, $R^{22}$ and $R^{13}$ have substituent groups, the substituent groups include a halogen atom, an alkyl group, an aryl group, an alkoxyl group, an amino group, an acyl group, an acylamino group, an alkylthio group, an arylthio group, a sulfonamido group, an acyloxy group, an oxycarbonyl group, a carbamoyl group, a sulfamoyl group, a sulfonyl group and a phosphoryl group. Preferred are an alkyl group and an aryl group. Specific examples thereof include a methyl group, an ethyl group, an isopropyl group, a t-butyl group, a t-octyl group, a phenyl group, a 4-alkoxyphenyl group and a 4-acyloxyphenyl group.

Specific examples of the groups represented by $R^{21}$, $R^{22}$ and $R^{23}$ include a substituted or unsubstituted alkyl group (e.g., methyl, ethyl, butyl, octyl, dodecyl, isopropyl, t-butyl, t-amyl, t-octyl, cyclohexyl, 1-methylcyclohexyl, benzyl, phenethyl, 2-phenoxypropyl), a substituted or unsubstituted aryl group (e.g., phenyl, cresyl, xylyl, naphthyl, 4-t-butylphenyl, 4-t-octylphenyl, 4-anisidyl, 3,5-dichlorophenyl), a substituted or unsubstituted alkoxyl group (e.g., methoxy, ethoxy, butoxy, octyloxy, 2-ethylhexyloxy, 3,5,5-trimethylhexyloxy, dodecyloxy, cyclohexyloxy, 4-methylcyclohexyloxy, benzyloxy), a substituted or unsubstituted aryloxy group (e.g., phenoxy, cresyloxy, isopropylphenoxy, 4-t-butylphenoxy, naphthoxy, biphenyloxy), a substituted or unsubstituted amino group (e.g., amino, dimethylamino, diethylamino, dibutylamino, dioctylamino, N-methyl-N-hexylamino, dicyclohexylamino, diphenylamino, N-methyl-N-phenylamino), and a heterocyclic group (e.g., 2-pyridyl, 4-pyridyl, 2-furanyl, 4-piperidinyl, 8-quinolyl, 5-quinolyl).

$R^{21}$, $R^{22}$ and $R^{23}$ are each preferably an alkyl group, an aryl group, an alkoxyl group or an aryloxy group. In respect to the effects of the invention, at least one of $R^{21}$, $R^{22}$ and $R^{23}$ is preferably an alkyl group or an aryl group, and more preferably, two or more are each an alkyl group or an aryl group. $R^{21}$, $R^{22}$ and $R^{23}$ are preferably the same group in that it is available at low cost.

Specific examples of the compounds represented by formula (II) are shown below, but compounds which can be used in the invention are not limited thereto.

(II-1)

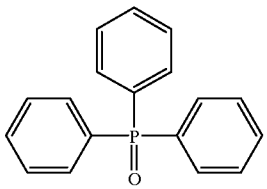

-continued (II-2)

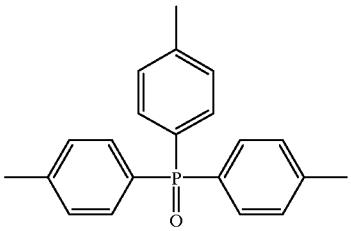

(II-3)

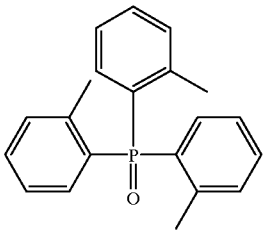

(II-4)

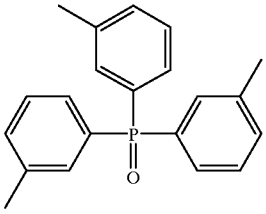

(II-5)

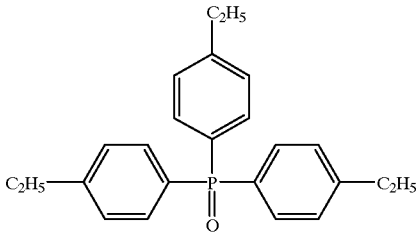

(II-6)

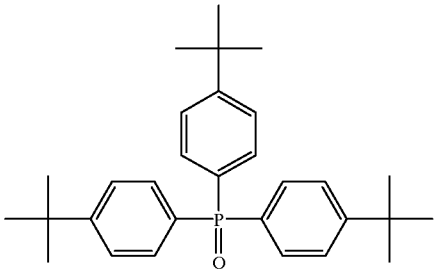

(II-7)

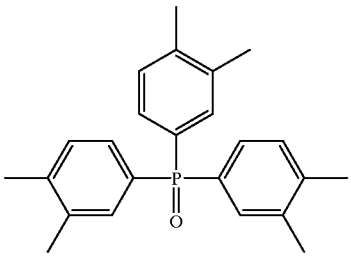

-continued
(II-8)
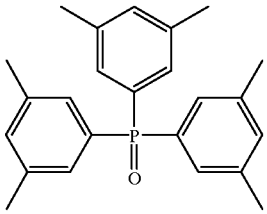
(II-9)
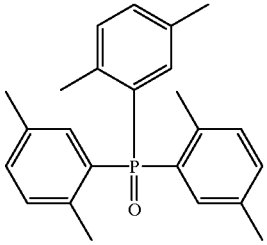
(II-10)
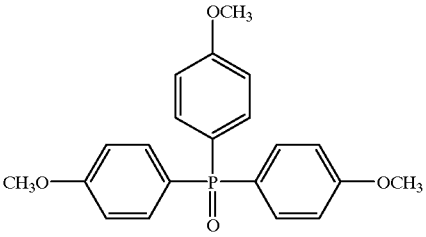
(II-11)
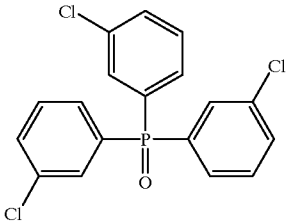
(II-12)
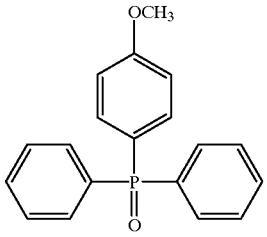
(II-13)
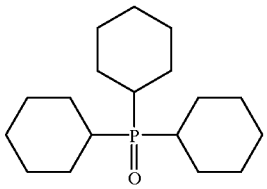
-continued
(II-14)
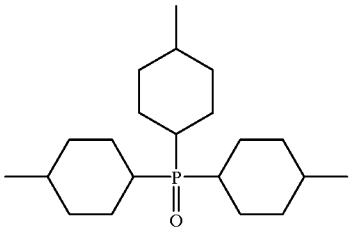
(II-15)
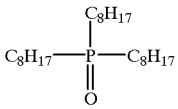
(II-16)
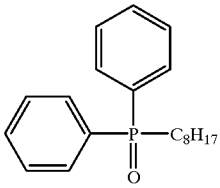
(II-17)
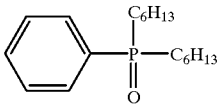
(II-18)
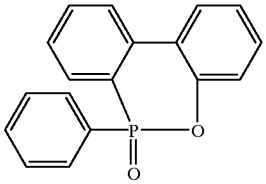
(II-19)
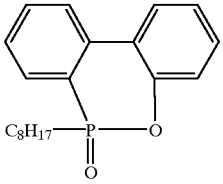
(II-20)
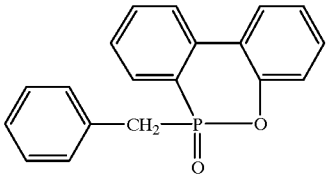
(II-21)
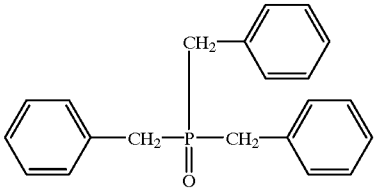

-continued
(II-22)
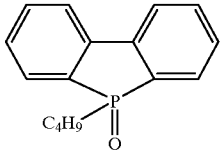
(II-23)
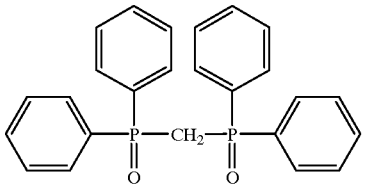
(II-24)
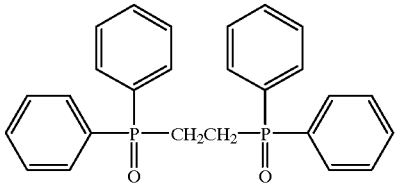
(II-25)
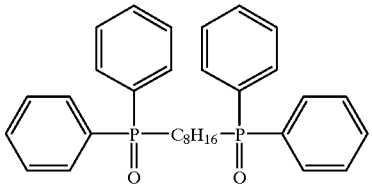
(II-26)
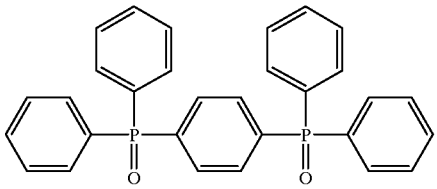
(II-27)
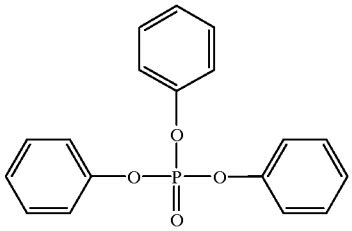
(II-28)
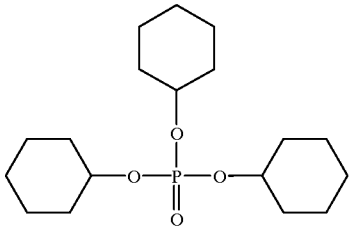
-continued
(II-29)
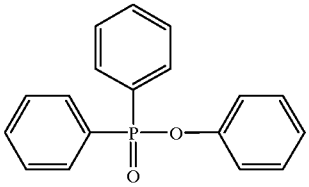
(II-30)
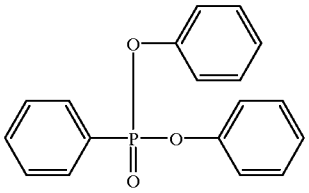
(II-31)
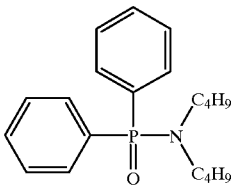
(II-32)
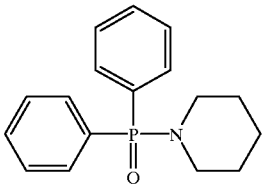
(II-33)
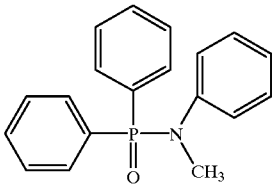
(II-34)
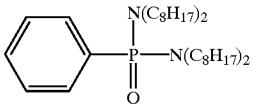
(II-35)
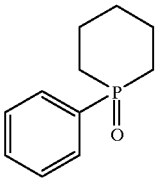
(II-36)
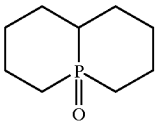

-continued (II-37)

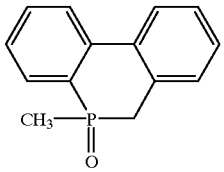

(II-38)

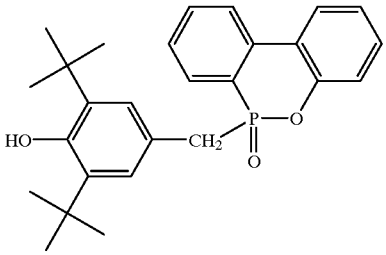

(II-39)

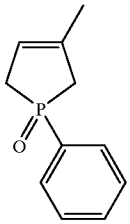

(II-40)

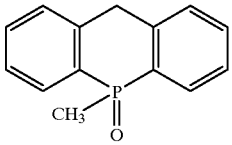

The hydrogen bonding compounds used in the invention can be added to coating solutions in any forms such as the form of solutions, the form of emulsified dispersions and the form of fine solid particle dispersions, thereby allowing them to be contained in the light-sensitive materials, similarly to the reducing agents. The hydrogen bonding compounds used in the invention form hydrogen bonding complexes with phenolic hydroxyl group- or amino group-containing compounds in the form of solutions, so that they can be isolated as the complexes in the crystalline form by a combination thereof with the reducing agents. It is particularly preferred for obtaining stable performance that crystalline powders of the complexes thus isolated are used as fine solid particle dispersions. A method can also be preferably used in which the reducing agents are mixed with the hydrogen bonding compounds in the powder form, and the resulting mixtures are dispersed in a sand grinder mill or the like using proper dispersants to perform complex formation during the dispersion.

The amount of the hydrogen bonding compound used is preferably from 1 to 200 mol %, more preferably from 10 to 150 mol %, and still more preferably from 30 to 100 mol %, based on the reducing agent.

The organic silver salt which can be used in the invention is relatively stable to light, and is a silver salt forming a silver image when heated to a temperature of 80° C. or more in the presence of an exposed photocatalyst (such as a latent image of a light-sensitive silver halide) and the reducing agent. The organic silver salt may be any organic substance containing a reducible silver ion source. Such light-insensitive organic silver salts are described in JP-A-10-62899 (the term "JP-A" as used herein means an "unexamined published Japanese patent application"), paragraph numbers 0048 to 0049, EP-A-0803764, page 18, line 24 to page 19, line 37, and EP-A-0962812. Silver salts of organic acids, particularly silver salts of long-chain aliphatic carboxylic acids (each having from 10 to 30 carbon atoms, and preferably from 15 to 28 carbon atoms) are preferred among others. Preferred examples of the organic silver salts include silver behenate, silver arachidate, silver stearate, silver oleate, silver laurate, silver caproate, silver myristate, silver palmitate and mixtures thereof. In the invention, of these organic silver salts and mixtures thereof, an organic acid silver salt having a silver behenate content of 75 mol % or more is preferably used.

There is no particular limitation on the form of the organic silver salts which can be used in the invention, and they may be acicular, rod-like, tabular or scaly.

In the invention, scaly organic silver salts are preferred. In this specification, the term "scaly organic silver salt" is defined as follows. The organic acid silver salt is observed under an electron microscope, and the form of an organic acid silver salt particle approximated to a rectangular parallelepiped. When the sides of this rectangular parallelepiped are taken as a, b and c from the shortest one (c may be equal to b), x is calculated by the following equation using shorter numerical values a and b:

$$X=b/a$$

x is determined in this manner for about 200 particles, and the average value thereof is taken as x (average). The particles satisfying the relationship of x (average)≧1.5 are defined as scaly particles. The relationship is preferably 30≧x (average)≧1.5, and more preferably 20≧x (average)≧2.0. By the way, when 1≧x (average) <1.5 is satisfied, the particles are defined as acicular particles.

In the scaly particle, a can be considered as the thickness of a tabular particle in which a plane having sides b and c is a main plane. The average of a is preferably from 0.01 μm to 0.23 μm, and more preferably from 0.1 μm to 0.20 μm. The average of c/b is preferably from 1 to 6, more preferably from 1.05 to 4, still more preferably from 1.1 to 3, and particularly preferably from 1.1 to 2.

It is preferred that the organic silver salt has monodisperse particle size distribution. The term "monodisperse" means that the percentage of a value of the standard deviation of each length of the short and long axes divided by each the short and long axes is preferably 100% or less, more preferably 80% or less, and still more preferably 50% or less. The form of the organic silver salt can be determined from an image of an organic silver salt dispersion observed under a transmission electron microscope. As another method for measuring the monodispersibility, there is a method of determining the standard deviation of volume weighted average diameters of the organic silver salt. The percentage (the coefficient of variation) of values divided by volume weighted average diameters is preferably 80% or less, and more preferably 50% or less. This can be determined, for example, from particle sizes (volume weighted average diameters) determined by irradiating laser light to the organic silver salt dispersed in a solution and determining the autocorrelation function to changes in fluctuation of its scattered light with time.

To methods for producing and dispersing the organic acid silver salts used in the invention, known methods can be applied. For example, reference can be made to JP-A-10-62899, EP-A-0803763 and EP-A-0962812.

In the invention, the coexistence of a light-sensitive silver salt in dispersing the organic silver salt results in an increase in fog and significant deterioration of sensitivity. Accordingly, it is more preferred that a light-sensitive silver salt is not substantially contained in dispersing the organic silver salt. In the invention, the amount of the light-sensitive silver salt contained in an aqueous dispersion is preferably 0.1 mol % or less per mol of organic acid silver salt in the dispersion, and the light-sensitive silver salt is not positively added.

In the invention, the organic silver salts can be used in a desired amount. However, they are used preferably in an amount of 0.1 to 5 g/m$^2$, and more preferably in an amount of 1 to 3 g/m$^2$, in terms of silver.

There is no particular limitation on the composition of the light-sensitive silver halides used in the invention, and silver chloride, silver chlorobromide, silver bromide, silver iodobromide and silver iodochlorobromide can be used. The distribution of the halogen composition in the grain of the light-sensitive silver halide may be uniform, or the halogen composition may vary stepwise or continuously. Further, silver halide grains having the core/shell structure can be preferably used. Double to fivefold structure type core/shell grains can be preferably used, and double to fourfold structure type core/shell grains can be more preferably used. Furthermore, a technique of localizing silver bromide on the surfaces of silver chloride or silver chlorobromide grains can also preferably used.

Methods for forming the light-sensitive silver halides are well known in the art. For example, methods described in *Research Disclosure,* vol. 17029 (June, 1978) and U.S. Pat. No. 3,700,458 can be used. Specifically, a method of adding a silver supplying compound and a halogen supplying compound to a gelatin solution or another polymer solution to prepare a light-sensitive silver halide, and then, mixing the resulting silver halide with an organic silver salt is used. Methods described in JP-A-11-119374, paragraph numbers 0217 to 0224, Japanese Patent Application Nos. Hei. 11-98708 and Hei. 11-84182 are also preferred.

For inhibiting white turbidity after image formation, it is preferred that the grain size of the light-sensitive silver halide is small. Specifically, the grain size is preferably 0.20 $\mu$m or less, more preferably from 0.01 to 0.15 $\mu$m, and still more preferably from 0.02 to 0.12 $\mu$m. The term "grain size" as used herein means the diameter of a circle image to which a projected area (in the case of a tabular grain, a projected area of a main surface) of the silver halide grain is converted, the circle image having the same area as the projected area.

The form of the silver halide grains may be cubic, octahedral, tabular, spherical, rod-like or pebble-like. In the invention, however, cubic grains are particularly preferred. Silver halide grains having rounded corners can also be preferably used. There is no particular limitation on the surface index (mirror index) of outer surfaces of the light-sensitive silver halide grains. However, it is preferred that the ratio of the {100} face is high, the {100} face having high spectral sensitization efficiency when a spectral sensitizing dye is adsorbed thereby. The ratio is preferably 50% or more, more preferably 65% or more, and most preferably 80% or more. The ratio of the mirror index {100} face can be determined by a method described in T. Tani, *Imaging Sci.,* 29, 165 (1985), utilizing adsorption dependency of the {111} face and the {100} face in adsorption of a sensitizing dye.

In the invention, silver halide grains in which a hexacyano metal complex is allowed to exist on uppermost surfaces of the grains are preferred. The hexacyano metal complexes include $[Fe(CN)_6]^{4-}$, $[Fe(CN)_6]^{3-}$, $[Ru(CN)_6]^{4-}$, $[Os(CN)_6]^{4-}$, $[CO(CN)_6]^{3-}$, $[Rh(CN)_6]^{3-}$, $[Ir(CN)_6]^{3-}$, $[Cr(CN)_6]^{3-}$ and $[Re(CN)_6]^{3-}$. In the invention, hexacyano Fe complexes are preferred.

Counter cations are not important, because the hexacyano metal complexes exist in the form of ions in aqueous solutions. However, alkali metal ions such as sodium ions, potassium ions, rubidium ions, cesium ions and lithium ions, ammonium ions, and alkylammonium ions (e.g., tetramethylammonium ions, tetraethylammonium ions, tetrapropylammonium ions, tetra (n-butyl) ammonium ions), which are miscible with water and compatible for precipitation operations of silver halide emulsions, are preferably used as the counter cations.

The hexacyano metal complexes can be added as mixtures thereof with mixed solvents of water and proper water-miscible organic solvents (e-g., alcohols, ethers, glycols, ketones, esters and amides) or gelatin, as well as water.

The amount of the hexacyano metal complex added is preferably from $1\times10^{-5}$ to $1\times10^{-2}$ mol, and more preferably from $1\times10^{-4}$ to $1\times10^{-3}$ mol.

For allowing the hexacyano metal complex to exist on the uppermost surfaces of the silver halide grains, the hexacyano metal complex is directly added after the termination of the addition of an aqueous solution of silver nitrate used for grain formation, before the termination of charging until before chemical sensitization in which chalcogen sensitization such as sulfur sensitization, selenium sensitization and tellurium sensitization, or noble metal sensitization such as gold sensitization is conducted, during washing, during dispersion or before chemical sensitization. In order to prevent the silver halide grains from growing, it is preferred that the hexacyano metal complex is added immediately after grain formation, and before the termination of charging.

The addition of the hexacyano metal complex may be initiated after 96% by weight of the total amount of silver nitrate added for grain formation has been added, preferably after the addition of 98% by weight, and particularly preferably after the addition of 99% by weight.

When the hexacyano metal complex is added after the addition of the aqueous solution of silver nitrate immediately before the completion of grain formation, the complex can be adsorbed by the uppermost surfaces of the silver halide grains, and almost forms a slightly soluble salt with silver ions on the grain surfaces. The silver salt of hexacyanoferric (II) acid is a salt more slightly soluble than AgI, so that redissolution caused by fine grains can be prevented, which makes it possible to produce fine silver halide grains having small grain size.

The light-sensitive silver halide grains used in the invention can contain metals of groups 8 to 10 in the periodic table (showing groups 1 to 18) or metal complexes. The metals of groups 8 to 10 in the periodic table or central metals of the metal complexes are preferably rhodium, ruthenium and iridium. These metal complexes may be used either alone or as a combination of two or more of complexes comprising the same kind or different kinds of metals. The content thereof is preferably from $1\times10^{-9}$ to $1\times10^{-3}$ mol per mol of silver. These metals, metal complexes and methods for adding them are described in JP-A-7-225449, JP-A-11-65021, paragraph numbers 0018 to 0024, and JP-A-11-119374, paragraph number 0227 to 0240.

Further, metal atoms which can be contained in the silver halide grains used in the invention (e.g., $[Fe(CN)_6]^{4-}$), desalting methods and chemical sensitizing methods of the silver halide emulsions are described in JP-A-11-84574, paragraph numbers 0046 to 0050, JP-A-11-65021, paragraph numbers 0025 to 0031, and JP-A-11-119374, paragraph number 0242 to 0250.

Various kinds of gelatins can be used in the light-sensitive silver halide emulsions used in the invention. In order to keep good the dispersing state of the light-sensitive silver halide emulsions in organic silver salt-containing coating solutions, it is preferred that low molecular weight gelatins having a molecular weight of 500 to 60,000 are used. Although these low molecular weight gelatins may be used in forming the grains, or in dispersing the grains after desalting, they are preferably used in dispersing the grains after desalting.

As sensitizing dyes applicable to the invention, there can be selected sensitizing dyes which can spectrally sensitize the silver halide grains in a desired wavelength region when adsorbed by the silver halide grains, and which have spectral sensitivity suitable for the spectral characteristics of an exposure light source. The sensitizing dyes and methods for adding them are described in JP-A-11-65021, paragraph numbers 0103 to 0109, JP-A-10-186572 (compounds represented by formula (II)), JP-A-11-119374 (dyes represented by formula (I) and paragraph number 0106), U.S. Pat. Nos. 5,510,236 and 3,871,887 (dyes described in Example 5), JP-A-2-96131, JP-A-59-48753 (dyes described therein), EP-A-0803764, page 19, line 38 to page 20, line 35, and Japanese Patent Application Nos. 2000-86865 and 2000-102560. These sensitizing dyes may be used either alone or as a combination of two or more of them.

In the invention, the sensitizing dyes are added to the silver halide emulsions preferably from after desalting to coating, and more preferably from after desalting to before the start of chemical ripening.

In the invention, the sensitizing dyes may be used in a desired amount depending on performances such as sensitivity and fog. However, they are used preferably in an amount of $10^{-6}$ to 1 mol, and more preferably in an amount of $10^{-4}$ to $10^{-1}$ mol, per mol of silver halide of the light-sensitive layer.

In the invention, for improving spectral sensitization efficiency, supersensitizing agents can be used. The supersensitizing agents used in the invention include compounds described in EP-A-587,338, U.S. Pat. Nos. 3,877,943 and 4,873,184, JP-A-5-341432, JP-A-11-109547 and JP-A-10-111543.

In the invention, it is preferred that the light-sensitive silver halide grains are chemically sensitized by sulfur sensitization, selenium sensitization or tellurium sensitization. As compounds preferably used for sulfur sensitization, selenium sensitization and tellurium sensitization, there can be used known compounds, for example, compounds described in JP-A-7-128768. In particular, tellurium sensitization is preferably used in the invention, and more preferred are compounds described in JP-A-11-65021, paragraph number 0030, and compounds represented by formulas (II), (III) and (IV) in JP-A-5-313284.

In the invention, chemical sensitization is possible at any time, such as (1) before spectral sensitization, (2) concurrently with spectral sensitization, (3) after spectral sensitization or (4) immediately before coating, after desalting, as long as it is conducted after grain formation and before coating. In particular, chemical sensitization is preferably conducted after spectral sensitization.

The amount of sulfur, selenium and tellurium sensitizers used in the invention is from $1\times10^{-8}$ to $1\times10^{-2}$ mol, and preferably from about $1\times10^{-7}$ to about $1\times10^{-3}$ mol, per mol of silver halide, although it varies depending on the silver halide grains used and the chemical ripening conditions. There is no particular limitation on the conditions of chemical sensitization in the present invention. However, the pH is from 5 to 8, the pAg is from 6 to 11, and the temperature is from about 40° C. to about 95° C.

Thiosulfonic acid compounds may be added to the silver halide emulsions used in the invention by a method shown in EP-A-293,917.

The light-sensitive silver halide emulsions in the light-sensitive materials used in the invention may be used either alone or as a combination of two or more of them (for example, emulsions different in mean grain size, emulsions different in halogen composition, emulsions different in crystal habit, and emulsions different in the conditions of chemical sensitization). The use of plural kinds of light-sensitive silver halides different in sensitivity allows the gradation to be controlled. Techniques relating to these are described in JP-A-57-119341, JP-A-53-106125, JP-A-47-3929, JP-A-48-55730, JP-A-46-5187, JP-A-50-73627 and JP-A-57-150841. As to the difference in sensitivity, a difference of 0.2 log E or more is preferably given between the respective emulsions.

The amount of the light-sensitive silver halide used is preferably from 0.03 to 0.6 g/m$^2$, more preferably from 0.05 to 0.4 g/m$^2$, and still more preferably from 0.1 to 0.4 g/m$^2$, in terms of the amount of silver coated per m$^2$ of light-sensitive material. It is preferably from 0.01 mol to 0.5 mol, and more preferably from 0.02 mol to 0.3 mol, per mol of organic silver salt.

In the invention, it is possible to produce the light-sensitive material by mixing an aqueous dispersion of the organic silver salt and an aqueous dispersion of the light-sensitive silver salt. In mixing, it is a preferred method for adjustment of photographic characteristics that two or more kinds of aqueous dispersions of the organic silver salts are mixed with two or more kinds of aqueous dispersions of the light-sensitive silver salts.

As processes for mixing the light-sensitive silver halides with the organic silver salts separately prepared and mixing conditions thereof, there are a method of mixing the separately prepared silver halide grains and organic silver salt with each other in a high-speed stirrer, a ball mill, a sand mill, a colloid mill, a vibrating mill or a homogenizer, and a method of mixing the prepared light-sensitive silver halide at any timing during preparation of the organic silver salt to prepare the organic silver salt. However, there is no particular limitation thereon, as long as the effects of the invention are sufficiently manifested.

In the invention, the light-sensitive silver halides are preferably added to the coating solutions for image forming layers from 180 minutes before coating to immediately before coating, preferably from 60 minutes before coating to 10 seconds before coating. However, there is no particular limitation on the mixing process and the mixing conditions, as long as the effects of the invention are sufficiently manifested. Specific examples of the mixing processes include a mixing process using a tank designed so that the average residence time calculated from the flow rate of the solution added and the amount of the solution supplied to a coater becomes a desired time, and a process using static mixers described in N. Harnby, M. F. Edwards and A. W. Nienow, translated by Koji Takahashi, *Liquid Mixing Techniques,* chapter 8, published by Nikkan Kogyo Shinbunsha (1989).

Binders for the organic silver salt-containing layers may be any polymers, and suitable binders are transparent or translucent and generally colorless. They are natural and synthetic resins (polymers and copolymers) and other film forming media, and examples thereof include gelatin compounds, rubber compounds, poly(vinyl alcohol) compounds, hydroxyethyl cellulose compounds, cellulose acetate compounds, cellulose acetate butylate compounds, poly(vinylpyrrolidone) compounds, casein, starch, poly (acrylic acid) compounds, poly(methyl methacrylate) compounds, poly(vinyl chloride) compounds, poly (methacrylic acid) compounds, styrene-maleic anhydride copolymers, styreneacrylonitrile copolymers, styrene-butadiene copolymers, poly(vinyl acetal) polymers (e.g., poly(vinyl formal), poly(vinyl butyral)), polyesters, polyurethanes, phenoxy resins, poly(vinylidene chloride) compounds, polyepoxides, polycarbonates, poly(vinyl acetate) compounds, polyolefins, cellulose esters and polyamides. The binders may be formed from aqueous solutions, organic solvent solutions or emulsions by coating.

In the invention, when the organic silver salt-containing layer is formed by applying a coating solution in which 30% by weight or more of a solvent is water and drying it, the binder of the organic silver salt-containing layer is preferably soluble or dispersible in an aqueous solvent (water solvent) and particularly preferably composed of a polymer latex having an equilibrium moisture content of 2% by weight or less at 25° C., 60% RE. The most preferred form is one prepared so as to give an ionic conductivity of 2.5 mS/cm or less, and methods for preparing such one include a method of purifying the polymer with a separation functional membrane after synthesis thereof.

The term "an aqueous solvent in which the binder is soluble or dispersible" as used herein means water or a mixture of water and 70% by weight or less of a water-soluble or aqueous-miscible organic solvent. The aqueous-miscible organic solvents include, for example, alcohol solvents such as methyl alcohol, ethyl alcohol and propyl alcohol, cellosolve solvents such as methyl cellosolve, ethyl cellosolve and butyl cellosolve, ethyl acetate and dimethylformamide.

In the case of a system in which the polymer is not dissolved thermodynamically to exist in a so-called dispersion state, the term "aqueous solvent" is also used herein.

The term "equilibrium moisture content at 25° C., 60% RH" as used herein can be expressed using the weight $W^1$ of a polymer attaining equilibrium with moisture in the atmosphere of 25° C. and 60% RH and the weight $W^0$ of the polymer in the absolute dry condition at 25° C. as follows:

$$\text{Equilibrium Moisture Content at } 25^\circ\text{ C., } 60\%\ RH=\{(W^1-W^0)/W^0\}\times 100\ (\%\text{ by weight})$$

For the definition of the moisture content and the measuring method thereof, reference can be made to *Kobunshi Kogaku Koza* (Polymer Engineering Course), 14, "Test Methods of Polymer Materials" (edited by Kobunshi Gakkai, Chijin Shokan).

The equilibrium moisture content of the binder polymer used in the invention at 25° C., 60% RH is preferably 2% by weight or less, more preferably from 0.01% to 1.5% by weight, and still more preferably from 0.02% to 1% by weight.

In the invention, polymers dispersible in the aqueous solvents are particularly preferred. Examples of the dispersion states include latexes in which fine particles of water-insoluble hydrophobic polymers are dispersed, and dispersions of polymer molecules dispersed in a molecular state or forming micelles, both of which are preferred. The mean particle size of the dispersed particles is preferably from about 1 nm to about 50,000 nm, and more preferably from about 5 nm to about 1,000 nm. There is no particular limitation on the particle size distribution of the dispersed particles. The particles may be either ones having a wide particle size distribution or ones having a monodisperse particle size distribution.

In the invention, preferred examples of the polymers dispersible in the aqueous solvents include hydrophobic polymers such as acrylic polymers, polyesters, rubber compounds (e.g., SBR resins), polyurethanes, poly(vinyl chloride) compounds, poly(vinyl acetate) compounds, poly (vinylidene chloride) compounds and polyolefins. These polymers may be straight chain polymers, branched polymers or crosslinked polymers. Further, the polymers may be either so-called homopolymers in which a single monomer is polymerized, or copolymers in which two or more kinds of monomers are polymerized. The copolymers may be either random copolymers or block copolymers. The number average molecular weight of the polymer is preferably from 5,000 to 1,000,000, and more preferably from 10,000 to 200,000. Too low a molecular weight unfavorably results in insufficient mechanical strength of the emulsion layer, whereas too high a molecular weight causes poor film forming properties.

Preferred examples of the polymer latexes include the following, wherein the polymers are represented by raw material monomers, the numerals in parentheses are percentages by weight, and the molecular weight is the number average molecular weight.

P-1: Latex of -MMA(70)-EA(27)-MAA(3)- (molecular weight: 37,000);

P-2: Latex of -MMA(70)-2EHA(20)-St(5)-AA(5)- (molecular weight: 40,000);

P-3: Latex of -St(50)-Bu(47)-MAA(3)- (molecular weight: 45,000);

P-4: Latex of -St(68)-Bu(29)-AA(3)- (molecular weight: 60,000);

P-5: Latex of -St(71)-Bu(26)-AA(3)- (molecular weight: 60,000)

P-6: Latex of -St(70)-Bu(27)-IA(1)- (molecular weight: 120,000);

P-7: Latex of -St(75)-Bu(24)-AA(1)- (molecular weight: 108,000);

P-8: Latex of -St(60)-Bu (35)-DVB(3)-MAA(2)- (molecular weight: 150,000);

P-9: Latex of -St(70)-Bu(25)-DVB(2)-AA(3)- (molecular weight: 280,000);

P-10: Latex of -VC(50)-MMA(20)-EA(20)-AN(5)-AA (5)- (molecular weight: 80,000);

P-11: Latex of -VDC(85)-MMA(5)-EA(5)-MAA(5)- (molecular weight: 67,000);

P-12: Latex of -Et(90)-MMA(10)- (molecular weight: 12,000);

P-13: Latex of -St(70)-2EHA(27)-AA(3) (molecular weight: 130,000); and

P-14: Latex of -MMA (63)-EA(35)-AA(2) (molecular weight: 33,000).

Abbreviations used in the above-mentioned structures indicate the following monomers:

MMA; Methyl methacrylate, EA; Ethyl acrylate, MA; Methacrylic acid, 2EHA; 2-Ethylhexyl acrylate, St; Styrene, Bu; Butadiene, AA; Acrylic acid, DVB; Divinylbenzene, VC; Vinyl chloride, AN; Acrylonitrile, VDC; Vinylidene chloride, Et: Ethylene and IA; Itaconic acid.

The polymers described above are commercially available, and the following polymers can be utilized. Examples of the acrylic polymers include Cevian A-4635, 46583 and 4601 (the above products are manufactured by Daicel Chemical Industries, Ltd.) and Nipol Lx 811, 814, 821, 820 and 857 (the above products are manufactured by Nippon Zeon Co., Ltd), examples of the polyesters include FINETEX ES 650, 611, 675 and 850 (the above products are manufactured by Dainippon Ink & Chemicals, Inc.), and WD-size and WMS (the above products are manufactured by Eastman Chemical Co.), examples of the polyurethanes include HYDRAN AP 10, 20, 30 and 40 (the above products are manufactured by Dainippon Ink & Chemicals, Inc.), examples of the rubber compounds include LACSTAR 7310K, 3307B, 4700H and 7132C (the above products are manufactured by Dainippon Ink & Chemicals, Inc.) and Nipol Lx 416, 410, 438C and 2507 (the above products are manufactured by Nippon Zeon Co., Ltd.), examples of the poly(vinyl chloride) compounds include &351 and G576 (the above products are manufactured by Nippon Zeon Co., Ltd.), examples of the poly(vinylidene chloride) compounds include L502 and L513 (the above -" products are manufactured by Asahi Chemical Industry Co., Ltd.), and examples of the polyolefins include Chemipearl S120 and SA100 (the above products are manufactured by Mitsui Petrochemical Industries, Ltd.).

These polymer latexes may be used either alone or as a mixture of two or more of them as required.

As the polymer latexes used in the invention, styrene-butadiene copolymer latexes are particularly preferred. In the styrene-butadiene copolymer latex, the weight ratio of styrene monomer units to butadiene monomer units is preferably from 40:60 to 95:5. Further, the ratio of the styrene monomer units and the butadiene monomer units to the copolymer is preferably from 60% to 99% by weight. The preferred molecular weight range is the same as described above.

The styrene-butadiene copolymer latexes which can be preferably used in the invention include P-3 to P-8 described above and commercially available LACSTAR-3307B, 7132C and Nipol Lx416.

The glass transition temperature (Tg) of the polymer latex preferably used as the binder used in the invention is preferably from 10 to 80° C., more preferably from 15 to 70° C. and still more preferably from 20 to 60° C. When two or more kinds of latexes different in Tg are blended for use as the binder, it is preferred that the weight average Tg thereof is within the above-mentioned range.

The organic silver salt-containing layer of the heat developable light-sensitive material of the invention may further contain a hydrophilic polymer such as gelatin, polyvinyl alcohol, methyl cellulose, hydroxypropyl cellulose or carboxymethyl cellulose. The amount of the hydrophilic polymer added is preferably 30% by weight or less, and more preferably 20% by weight or less, based on the total binder of the organic silver salt-containing layer.

The organic silver salt-containing layer (that is to say, the image formation layer) of the invention is preferably formed using the polymer latex, and for the amount of binder contained in the organic silver salt-containing layer, the weight ratio of total binder/organic silver salt is preferably from 1/10 to 10/1, and more preferably from 1/5 to 4/1.

Further, such an organic silver salt-containing layer is also usually a light-sensitive layer (emulsion layer) containing the light-sensitive silver halide that is the light-sensitive silver salt. In such a case, the weight ratio of total binder/silver halide is preferably from 400 to 5, and more preferably from 200 to 10.

In the invention, the total binder amount of the image formation layer is preferably from 0.2 to 30 g/m$^2$, and more preferably from 1 to 15 g/m$^2$. The image formation layer may contain a crosslinking agent for crosslinking and a surfactant for improving coating properties.

In the invention, the solvent (both the solvent and the dispersing medium are referred to as the solvent herein for brevity) for a coating solution for the organic silver salt-containing layer is preferably an aqueous solvent containing water in an amount of 30% by weight or more. As components other than water, any water-miscible organic solvents such as methyl alcohol, ethyl alcohol, isopropyl alcohol, methyl cellosolve, ethyl cellosolve, dimethylformamide and ethyl acetate may be used. The water content of the solvent of the coating solution is preferably 50% by weight or more, and more preferably 70% by weight or more. Preferred examples of solvent compositions include water/methyl alcohol=90/10, water/methyl alcohol=70/30, water/methyl alcohol/dimethylformamide=80/15/5, water/methyl alcohol/ethyl cellosolve=85/10/5 and water/methyl alcohol/isopropyl alcohol=85/10/5 (wherein the numeral values are percentages by weight), as well as water.

Antifoggants, stabilizers and stabilizer precursors which can be used in the invention include ones disclosed in JP-A-10-62899, paragraph number 0070 and EP-A-0803764, page 20, line 57 to page 21, line 7. Further, antifoggants preferably used in the invention are organic halides, which include ones disclosed in JP-A-11-65021, paragraph numbers 0111 to 0112. In particular, organic halogen compounds represented by formula (P) of Japanese Patent Application No. Hei. 11-87297 and organic polyhalogen compounds represented by formula (II) of JP-A-10-339934 are preferred.

In the invention, polyhalogen compounds represented by formula (III) are preferably used as the antifoggants.

$$Q—(Y)_n—C(Z^1)(Z^2)X \quad \text{(III)}$$

wherein Q represents an alkyl group, an aryl group or a heterocyclic group; Y represents a divalent connecting group; n represents 0 or 1; $Z^1$ and $Z^2$ each independently represents a halogen atom; and X represents a hydrogen atom or an electron attractive group. The alkyl group, the aryl group or the heterocyclic group represented by Q may have a substituent group.

In formula (III), Q preferably represents a phenyl group substituted by an electron attractive group whose Hammett op constant is positive. Specific examples of the electron attractive groups, the substituent groups, include a cyano group, an alkoxycarbonyl group, an aryloxycarbonyl group, a carbamoyl group, a sulfamoyl group, an alkylsulfonyl group, an arylsulfonyl group, a sulfoxido group, an acyl group, a heterocyclic group, a halogen atom, an alkyl halide group and a phosphoryl group. The op constant is preferably from 0.2 to 2.0, and more preferably from 0.4 to 1.0. Particularly preferred electron attractive groups are a carbamoyl group, an alkoxycarbonyl group, an alkylsulfonyl group and an alkylphosphoryl group, and a carbamoyl group is most preferred among others.

Specific examples of the polyhalogen compounds represented by formula (III) are shown below, but compounds which can be used in the invention are not limited thereto.

(P-1)
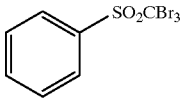
(P-2)
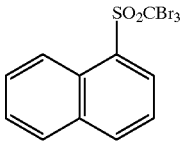
(P-3)
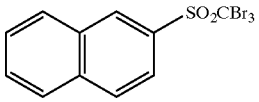
(P-4)
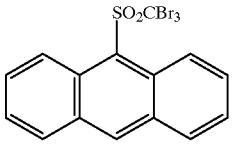
(P-5)
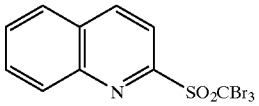
(P-6)
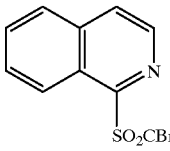
(P-7)
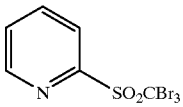
(P-8)
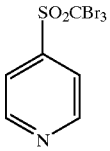
(P-9)
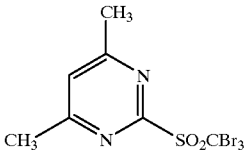
(P-10)
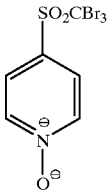
-continued
(P-11)
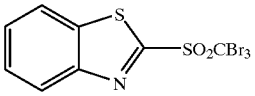
(P-12)
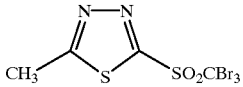
(P-13)
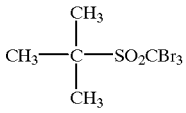
(P-14)
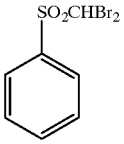
(P-15)
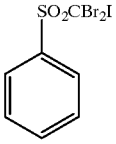
(P-16)
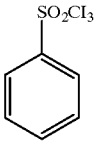
(P-17)
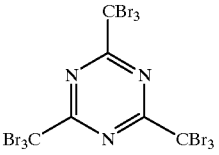
(P-18)
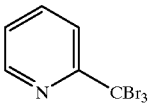
(P-19)
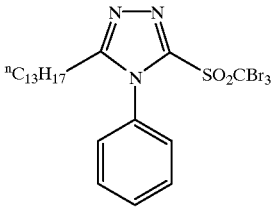
(P-20)
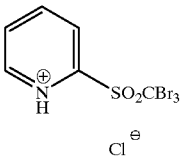

-continued
(P-21)
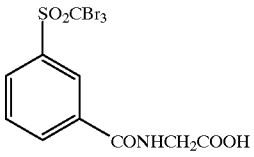
(P-22)
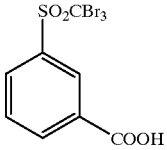
(P-23)
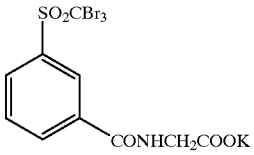
(P-24)
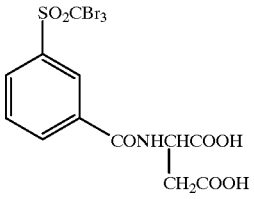
(P-25)
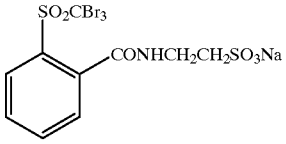
(P-26)
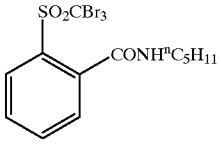
(P-27)
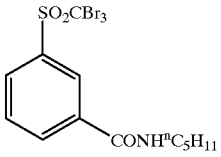
(P-28)
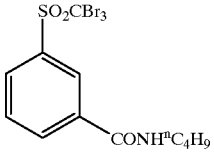
-continued
(P-29)
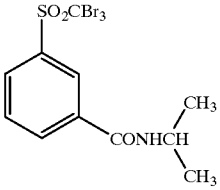
(P-30)
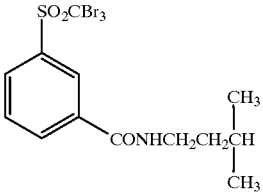
(P-31)
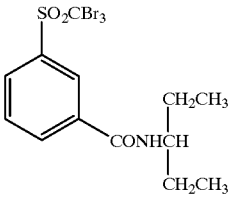
(P-32)
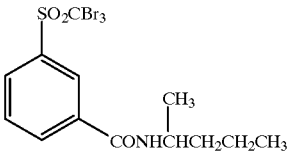
(P-33)
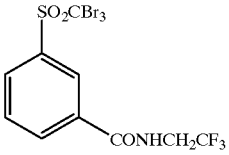
(P-34)
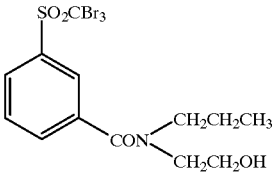
(P-35)
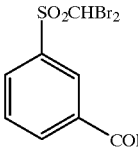
(P-36)
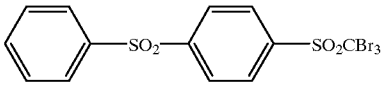

-continued (P-37)

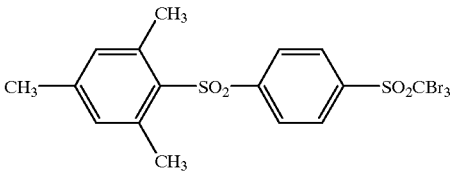

(P-38)

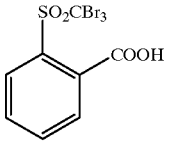

(P-39)

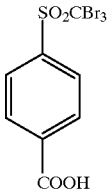

(P-40)

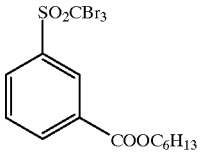

(P-41)

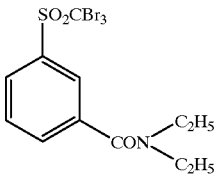

(P-42)

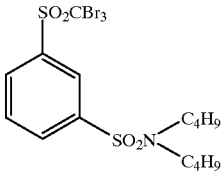

(P-43)

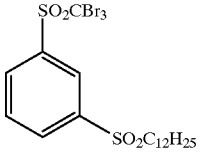

(P-44)

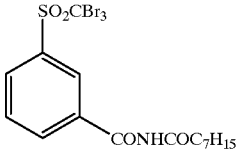

-continued (P-45)

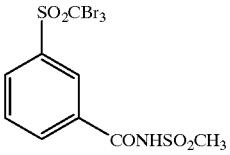

In the invention, methods for adding the antifoggants to the heat developable light-sensitive materials include the above-mentioned methods for adding the reducing agents to the light-sensitive materials, and the antifoggants are also preferably added as fine solid particle dispersions.

Other antifoggants include mercury (II) salts described in JP-A-11-65021, paragraph number 0113, benzoic acid derivatives described in JP-A-11-65021, paragraph number 0114, salicylic acid derivatives represented by formula (Z) of Japanese Patent Application No. Hei. 11-87297, formalin scavenger compounds represented by formula (S) of Japanese Patent Application No. Hei. 11-23995, triazine compounds according to claim 9 of JP-A-11-352624, compounds represented by formula (III) of JP-A-6-11791 and 4-hydroxy-6-methyl-1,3,3a,7-tetraazaindene.

The heat developable light-sensitive materials of the invention may contain azolium salts for the purpose of fog prevention. The azolium salts include compounds represented by formula (XI) described in JP-A-59-193447, compounds described in JP-B-55-12581 (the term "JP-B" as used herein means an "examined Japanese patent publication") and compounds represented by formula (II) described in JP-A-60-153039. Although the azolium salt may be added to any site of the light-sensitive material, it is preferably added to a layer on a side having the light-sensitive layer. More preferably, it is added to the organic silver salt-containing layer. The azolium salt may be added at any stage of the preparation of the coating solution. When added to the organic silver salt-containing layer, the azolium salt may be added at any stage from the preparation of the organic silver salt to the preparation of the coating solution, preferably from after the preparation of the organic silver salt to immediately before coating. The azolium salt may be added in any form such as a powder, a solution or a fine solid particle dispersion. Further, the azolium salt may be added as another solution in which it is mixed with another additive such as a sensitizing dye, a reducing agent or a color toning agent. In the invention, the azolium salt may be added in any amount, but preferably in an amount of $1\times10^{-6}$ to 2 mol, more preferably $1\times10^{-3}$ to 0.5 mol, per mol of silver.

The heat developable light-sensitive materials of the invention can contain mercapto compounds, disulfide compounds or thione compounds, for inhibiting or accelerating development to control development, improving the spectral sensitizing efficiency and improving keeping quality before and after development. Examples of such compounds are described in JP-A-10-62899, paragraph numbers 0067 to 0069, JP-A-10-186572 (compounds represented by formula (I) and specific examples described in paragraph numbers 0033 to 0052), EP-A-0803764, page 20, lines 36 to 56 and Japanese Patent Application No. Hei. 11-273670. Mercapto-substituted heteroaromatic compounds are preferred among others.

Color toning agents are preferably added to the heat developable light-sensitive materials of the invention. The color toning agents are described in JP-A-10-62899, paragraph numbers 0054 to 0055, EP-A-0803764, page 21, lines 23 to 48 and JP-A-2000-35631. Preferred are phthalazinone compounds (phthalazinone, phthalazinone derivatives or metal salts thereof, for example, 4-(1-naphthyl) phthalazinone, 6-chlorophthalazinone, 5,7-dimethoxyphthalazinone and 2,3-dihydro-1,4-phthalazinedione); combinations of phthalazinone compounds and phthalic acid compounds (e.g., phthalic acid, 4-methylphthalic acid, 4-nitrophthalic acid and tetrachlorophthalic acid anhydride); phthalazine compounds (phthalazine, phthalazine derivatives or metal salts thereof, for example, 4-(1-naphthyl)phthalazine, 6-isopropylphthalazine, 6-t-butylphthalazine, 6-chlorophthalazine, 5,7-dimethoxyphthalazine and 2,3-dihydrophthalazine); and combinations of phthalazine compounds and phthalic acid compounds. In particular, combinations of phthalazine compounds and phthalic acid compounds are preferred.

In the invention, plasticizers and lubricants which can be used in the light-sensitive layers are described in J-P-A-11-65021, paragraph number 0117, and super hard gradation enhancers for formation of super hard images are described in JP-A-11-65021, paragraph number 0118, JP-A-11-223898, paragraph numbers 0136 to 0193, Japanese Patent Application No. Hei. 11-87297 (compounds of formulas (E), (1) to (3), (A) and (B)) and Japanese Patent Application No. Hei. 11-91652 (compounds of formulas (III) to (V), specific compounds: "KA 21" to "KA 24"). Hard gradation accelerators are described in JP-A-11-65021, paragraph number 0102, and JP-A-11-223898, paragraph numbers 0194 to 0195.

For using formic acid or a formate as a strong fogging material, it is added to a side having a light-sensitive silver halide-containing image formation layer preferably in an amount of 5 mmol or less, and more preferably in an amount of 1 mmol or less, per mol of silver.

When the super hard gradation enhancers are used in the heat developable light-sensitive materials of the invention, acids produced by hydration of diphosphorus pentaoxide or salts thereof are preferably used in combination therewith. The acids produced by hydration of diphosphorus pentaoxide or the salts thereof include metaphosphoric acid and salts thereof, pyrophosphoric acid and salts thereof, orthophosphoric acid and salts thereof, triphosphoric acid and salts thereof, tetraphosphoric acid and salts thereof, and hexametaphosphoric acid and salts thereof. Particularly preferred are orthophosphoric acid and salts thereof, and hexametaphosphoric acid and salts thereof. Specific examples of the salts are sodium orthophosphate, sodium dihydrogenorthophosphate, sodium hexametaphosphate and ammonium hexametaphosphate.

The acids produced by hydration of diphosphorus pentaoxide or the salts thereof may be used in a desired amount depending on performances such as sensitivity and fog. However, the amount thereof used (the amount thereof coated per $m^2$ of light-sensitive material) is preferably from 0.1 to 500 $mg/m^2$, and more preferably from 0.5 to 100 $mg/m^2$.

The heat developable light-sensitive material of the invention can be provided with a surface protective layer for preventing adhesion of the image formation layer. The surface protective layer may be composed of a single layer or multiple layers. The surface protective layers are described in JP-A-11-65021, paragraph numbers 0119 to 0120.

As a binder for the surface protective layer of the invention, gelatin is preferred. However, the use of polyvinyl alcohol (PVA) is also preferred. As the gelatin, there can be used inert gelatin (for example, Nitta gelatin 750) and phthalated gelatin (for example, Nitta gelatin 801). The PVA includes PVA-105, a completely saponified product, PVA-205 and PVA-335, partially saponified products, and MP-203, modified polyvinyl alcohol (the above are names of commercial products manufactured by Kuraray Co., Ltd.). The amount of polyvinyl alcohol coated (per $m^2$ of support) for every one protective layer is preferably from 0.3 to 4.0 $g/m^2$, and more preferably from 0.3 to 2.0 $g/m^2$.

In particular, when the heat developable light-sensitive material of the invention is used for printing application in which changes in dimension cause trouble, it is preferred that a polymer latex is also used in the protective layer or a back layer. Such polymer latexes are described in *Synthetic Resin Emulsions,* edited by Taira Okuda and Hiroshi Inagaki, published by Kobunshi Kankokai (1978), *Application of Synthetic Latexes,* edited by Takaaki Sugimura, Yasuo Kataoka, Soichi Suzuki and Keiji Kasahara, published by Kobunshi Kankokai (1993) and Soichi Muroi, *Chemistry of Synthetic Latexes,* published by Kobunshi Kankokai (1970), and specific examples thereof include a methyl methacrylate (33.5% by weight)/ethyl acrylate (50% by weight)/methacrylic acid (16.5% by weight) copolymer latex, a methyl methacrylate (47.5% by weight)/butadiene (47.5% by weight)/itaconic acid (5% by weight) copolymer latex, an ethyl acrylate/methacrylic acid copolymer latex, a methyl methacrylate (58.9% by weight)/2-ethylhexyl acrylate (25.4% by weight)/styrene (8.6% by weight)/2-hydroxyethyl methacrylate (5.1% by weight)/acrylic acid (2.0% by weight) copolymer latex, and a methyl methacrylate (64.0% by weight)/styrene (9.0% by weight)/butyl acrylate (20.0% by weight)/2-hydroxyethyl methacrylate (5.0% by weight)/acrylic acid (2.0% by weight) copolymer latex. Further, as the binders for the surface protective layers, there may be applied combinations of polymer latexes described in Japanese Patent Application No. Hei. 11-6872, techniques described in Japanese Patent Application No. Hei. 11-143058, paragraph numbers 0021 to 0025, techniques described in Japanese Patent Application No. Hei. 11-6872, paragraph numbers 0027 to 0028, and techniques described in JP-A-2000-16409, paragraph numbers 0023 to 0041. The amount of the polymer latex in the surface protective layer is preferably from 10% to 90% by weight, and more preferably from 20% to 80% by weight, based on the total binder.

The amount of the total binder (including a water-soluble polymer and the polymer latex) coated (per $m^2$ of support) for every one surface protective layer is preferably from 0 3 to 5.0 $g/m^2$, and more preferably from 0.3 to 2.0 $g/m^2$.

In the invention, the preparation temperature of the coating solutions for the image formation layers is preferably from 30° C. to 65° C., more preferably from 35° C. to less than 60° C., and still more preferably from 35° C. to 55° C. Further, the temperature of the coating solutions for the image formation layers immediately after addition of the polymer latexes is preferably maintained at a temperature of 30° C. to 65° C. Furthermore, it is preferred that the reducing agents and the organic silver salts are mixed before addition of the polymer latexes.

In the invention, the image formation layer is constituted on a support as one or more layers. When constituted by one layer, the layer comprises the organic silver salt, the light-sensitive silver halide, the reducing agent and the binder, and optionally, additional materials such as the color toning agent, an auxiliary coating agent and other auxiliary agents When constituted by two or more layers, a first image formation layer (usually, a layer adjacent to the support) contains the organic silver salt and the light-sensitive silver halide, and a second image formation layer or both layers must contain some other components. The structure of a multicolor light-sensitive heat developable photographic material may contain a combination of these two layers for each color, or all components in a single layer as described in U.S. Pat. No. 4,708,928. In the case of a multi-dye multicolor light-sensitive heat developable photographic material, respective emulsion layers are generally kept distinguished from each other by using a functional or non-functional barrier layer between respective light-sensitive layers, as described in U.S. Pat. No. 4,460,681.

In the invention, the light-sensitive layers can contain various kinds of dyes and pigments (e.g., C.I. Pigment Blue 60, C.I. Pigment Blue 64 and C.I. Pigment Blue 15:6) from the viewpoints of improvement in a color tone, prevention of the occurrence of interference fringes at laser exposure and prevention of irradiation. These are described in detail in WO98/36322, JP-A-10-268465 and JP-A-11-338098.

In the heat developable light-sensitive material of the invention, an antihalation layer can be provided on the side far away from a light source with respect to the light-sensitive layer.

The heat developable light-sensitive materials generally have light-insensitive layers, in addition to the light-sensitive layers. The light-insensitive layers can be classified into four types: (1) a protective layer provided on the light-sensitive layer (on the side far away from the support), (2) an intermediate layer provided between the plurality of light-sensitive layers or between the light-sensitive layer and the protective layer, (3) an undercoat layer provided between the light-sensitive layer and the support, and (4) a back layer provided on the side opposite to the light-sensitive layer. The light-sensitive layer is provided with a filter layer as the layer of (1) or (2) and with an antihalation layer as the layer of (3) or (4).

The antihalation layers are described in JP-A-11-65021, paragraph numbers 0123 to 0124, JP-A-11-223898, JP-A-9-230531, JP-A-10-36695, JP-A-10-104779, JP-A-11-231457, JP-A-11-352625 and JP-A-11-352626.

The antihalation layer contains an antihalation dye having absorption at an exposure wavelength. When the exposure wavelength is in the infrared region, an infrared absorption dye is used, and in that case, a dye having no absorption in the visible region is preferably used.

When halation is prevented by using a dye having absorption in the visible region, it is preferred that the color of the dye does not substantially remain after image formation. For that purpose, a means of decoloring the dye by heat of heat development is preferably used, and particularly, it is preferred that a heat decoloring dye and a base precursor are added to the light-insensitive layer to allow it to act as an antihalation layer. These techniques are described in JP-A-11231457.

The amount of the decoloring dye added is determined depending on its purpose. In general, it is used in such an amount that an optical density (absorbance) exceeding 0.1 is given when measured at a desired wavelength. The optical density is preferably from 0.2 to 2. The amount of the dyes used for obtaining such optical density is generally from about 0.001 to about 1 g/m$^2$.

Such decoloring of the dyes allows the optical density after heat development to decrease to 0.1 or less. Two or more kinds of decoloring dyes may be used together. Similarly, two or more kinds of base precursors may be used together.

In heat decoloring using such decoloring dyes and base precursors, it is preferred in terms of heat decoloring properties that they are used in combination with substances (e.g., diphenyl sulfone and 4-chlorophenyl(phenyl) sulfone) decreasing the melting point by 3° C. or more by mixing with the base precursors as described in JP-A-11-352626.

In the invention, for improving the silver tone and the variation of images with the elapse of time, a coloring agent having the absorption maximum at 300 to 450 nm can be added. Such coloring agents are described in JP-A-62-210458, JP-A-63-104046, JP-A-63-103235, JP-A-63-208846, JP-A-63-306436, JP-A-63-314535, JP-A-01-61745 and Japanese Patent Application No. Hei. 11-276751.

Such a coloring agent is usually added in an amount ranging from 0.1 mg/m$^2$ to 1 g/m$^2$, and preferably added to a back layer provided on the side opposite to the light-sensitive layer.

It is preferred that the heat developable light-sensitive material of the invention is a so-called single-sided light-sensitive material having at least one silver halide emulsion-containing light-sensitive layer on one side of the support and the back layer on the other side.

In the invention, a matte agent is preferably added for improving the transferring properties. The matte agents are described in JP-A-11-65021, paragraph numbers 0126 to 0127. When indicated by the amount coated per m$^2$ of light-sensitive material, the amount of the matte agent coated is preferably from 1 to 400 mg/M$^2$ and more preferably from 5 to 300 mg/m$^2$.

The matte degree of an image formation layer surface may be any, as long as no stardust trouble occurs. However, the Beck smoothness is preferably from 30 to 2,000 seconds, and particularly preferably from 40 to 1,500 seconds. The Beck smoothness can be easily determined by the Japanese Industrial Standard (JIS) P8119, "Smoothness Test Method of Paper and Paperboard with Beck Tester" and the TAPPI Standard T479.

In the invention, the Beck smoothness of the back layer is preferably from 10 to 1,200 seconds, more preferably from 20 to 800 seconds, and still more preferably from 40 to 500 seconds.

In the invention, the matte agent is preferably contained in the outermost surface layer, a layer which functions as the outermost surface layer, or a layer close to the outer surface, of the light-sensitive material, and preferably contained in a layer which functions as the so-called protection layer.

The back layers applicable to the invention are described in JP-A-11-65021, paragraph numbers 0128 to 0130.

In the heat developable light-sensitive materials of the invention, the film surface pH before heat development processing is preferably 6.0 or less, and more preferably 5.5 or less. Although there is no particular limitation on the lower limit thereof, it is about 3. It is preferred from the viewpoint of reducing the film surface pH that the film surface pH is adjusted with organic acids such as phthalic acid derivatives, nonvolatile acids such as sulfuric acid, or volatile bases such as ammonia. In particular, ammonia is volatile and removable before the coating stage or heat development, so that it is preferred in that the low film surface pH is achieved. A method for measuring the film surface pH is described in Japanese Patent Application No. Hei. 11-87297, paragraph number 0123.

In the invention, a hardener may be used in each layer of the light-sensitive layer, the protective layer and the back layer. Examples of the hardeners are described in T. H. James, *THE THEORY OF THE PHOTOGRAPHIC PROCESS FOURTH EDITION,* pages 77 to 87, published by Macmillan Publishing Co., Inc. (1977), and multivalent metal ions described in ibid., page 78, polyisocyanates described in U.S. Pat. No. 4,281,060 and JP-A-6-208193, epoxy compounds described in U.S. Pat. No. 4,791,042 and vinyl sulfone compounds described in JP-A-62-89048, as well as chrome alum, 2,4-dichloro-6-hydroxy-s-triazine sodium salt, N,N-ethylenebis(vinyl sulfonacetoamide) and N,N-propylenebis(vinyl sulfonacetoamide), are preferably used.

The hardeners are added as solutions, and the solutions are preferably added to the coating solutions for protective layer from 180 minutes before coating to immediately before coating, preferably from 60 minutes before coating to 10 seconds before coating. However, there is no particular limitation on the mixing process and the mixing conditions, as long as the effects of the present invention are sufficiently manifested. Specific examples of the mixing processes include a mixing process using a tank designed so that the average residence time calculated from the flow rate of the solution added and the amount of the solution supplied to a coater becomes a desired time, and a process using a static mixer described in N. Harnby, M. F. Edwards and A. W. Nienow, translated by Koji Takahashi, *Liquid Mixing Techniques,* chapter 8, published by Nikkan Kogyo Shinbunsha (1989).

Surfactants applicable to the invention are described in JP-A-11-65021, paragraph number 0132, solvents in the same, paragraph number 0133, supports in the same, paragraph number 0134, antistatic or conductive layers in the same, paragraph number 0135, methods for obtaining color images in the same, paragraph number 0136, and lubricants in JP-A-11-84573, paragraph numbers 0061 to 0064 and Japanese Patent Application No. Hei. 11-106881, paragraph numbers 0049 to 0062.

As transparent supports, there are preferably used polyester films, particularly polyethylene terephthalate films subjected to heat treatment within the temperature range of 130° C. to 185° C. for relaxing internal strain remaining in the films in biaxial stretching to remove heat shrinkage strain generated in heat development processing. In the case of heat developable light-sensitive materials for medical application, the transparent supports may be either colored with blue dyes (for example, dye-I described in JP-A-8-240877, Example), or not colored. It is preferred that undercoating techniques of water-soluble polyesters described in JP-A-11-84574, styrene-butadiene copolymers described in JP-A-10-186565 and vinylidene chloride copolymers described in Japanese Patent Application No. Hei. 11-106881, paragraph numbers 0063 to 0080 are applied to the supports. Further, techniques described in JP-A-56-143430, JP-A-56-143431, JP-A-58-62646, JP-A-56-120519, JP-A-11-84573, paragraph numbers 0040 to 0051, U.S. Pat. No. 5,575,957 and JP-A-11-223898, paragraph numbers 0078 to 0084 can be applied to the antistatic layers and undercoating.

The heat developable light-sensitive materials of the invention are preferably of a mono-sheet type (a type in which images can be formed on the heat developable light-sensitive materials without the use of other sheets such as mage receiving materials).

Anti-oxidizing agents, stabilizers, plasticizers, ultraviolet absorbers and coating aids may be further added to the heat developable light-sensitive materials of the invention. Various additives are added to either the light-sensitive layers or the light-insensitive layers. For these additives, reference can be made to WO98/36322, EP-A-803764, JP-A-10-186567 and JP-A-10-18568.

The heat developable light-sensitive materials of the invention may be applied by any methods. Specifically, various coating operations including extrusion coating, slide coating, curtain coating, dip coating, knife coating, flow coating and extrusion coating using a hopper described in U.S. Pat. No. 2,681,294 are used. Extrusion coating described in Stephen F. Kistler and Petert M. Schweizer, *LIQUID FILM COATING,* pages 399 to 536, published by CHAPMAN & HALL (1997) or slide coating is preferably used, and slide coating is particularly preferably used. Examples of the shapes of slide coaters used in slide coating are shown in ibid., FIG. 11*b*. 1 on page 427. Two or more layers can be formed at the same time by methods described in ibid., pages 399 to 536, U.S. Pat. No. 2,761,791 and G.B. Patent 837,095, as so desired.

The coating solutions for the organic silver salt-containing layers used in the invention are preferably so-called thixotropic fluids. The thixotropy means the property that the viscosity decreases with an increase in the shear rate. Although any instruments may be used for measurement of the viscosity, an RFS fluid spectrometer manufactured by Rheometrics Far East Co. is preferably used and measurements are made at 25° C. Here, for the coating solutions for the organic silver salt-containing layers used in the invention, the viscosity at a shear rate of 0.1 $S^{-1}$ is preferably from 400 to 100,000 mpa·s, and more preferably from 500 to 20,000 mpa·s. Further, the viscosity at a shear rate of 1,000 $S^{-1}$ is preferably from 1 to 200 mPa·s, and more preferably from 5 to 80 mPa·s.

Various kinds of systems exhibiting the thixotropy are known, and described in *Koza Rheology* (*Course Rheology*) edited by Kobunshi Kankokai, and Muroi and Morino, *Polymer Latexes* (published by Kobunshi Kankokai. For allowing fluids to exhibit the thixotropy, they are required to contain many fine solid particles. Further, for enhancing the thixotropy, it is effective to contain thickening linear polymers, to increase the aspect ratio by the anisotropic form of the fine solid particles contained, and to use alkali thickening agents and surfactants.

Techniques which can be used in the heat developable light-sensitive materials of the invention are also described in EP-A-803764, EP-A-883022, WO98/36322, JP-A-56-62648, JP-A-58-62644, JP-A-9-281637, JP-A-9-297367, JP-A-9-304869, JP-A-9-311405, JP-A-9-329865, JP-A-10-10669, JP-A-10-62899, JP-A-10-69023, JP-A-10-186568, JP-A-10-90823, JP-A-10-171063, JP-A-10-186565, JP-A-10-186567, JP-A-10-186569 to JP-A-10-186572, JP-A-10-197974, JP-A-10-197982, JP-A-10-197983, JP-A-10-197985 to JP-A-10-197987, JP-A-10-207001, JP-A-10-207004, JP-A-10-221807, JP-A-10-282601, JP-A-10-288823, JP-A-10-288824, JP-A-10-307365, JP-A-10-312038, JP-A-10-339934, JP-A-11-7100, JP-A-11-15105, JP-A-11-24200, JP-A-11-24201, JP-A-11-30832, JP-A-11-84574, JP-A-11-65021, JP-A-11-109547, JP-A-11-125880, JP-A-11-129629, JP-A-11-133536 to JP-A-11-133539, JP-A-11-133542, JP-A-11-133543, JP-A-11-223898 and JP-A-11-352627.

Although the heat developable light-sensitive materials of the invention may be developed by any methods, the heat developable light-sensitive materials exposed imagewise are usually developed by elevating the temperature thereof. The developing temperature is preferably from 80° C. to 250° C., and more preferably from 100° C. to 140° C. The developing time is preferably from 1 to 180 seconds, more preferably from 10 to 90 seconds, and particularly preferably from 10 to 40 seconds.

As the heat development system, a plate heater system is preferred, and as the heat development system according to the plate heater system, a method described in JP-A-11-133572 is preferred. In this method, a heat development apparatus giving visible images by contacting the heat developable light-sensitive material having latent images formed with a heating means in a heat development unit is used, wherein the heating means comprises a plate heater, a plurality of press rollers are arranged along one side surface of the plate heater, facing thereto, and the heat developable light-sensitive material is allowed to pass between the press rollers and the plate heater to conduct heat development. It is preferred that the plate heater is divided into 2 to 6 steps and the temperature is decreased by about 1° C. to about 10° C. at a leading edge portion thereof. Such a method is also described in JP-A-54-30032, and water and an organic solvent contained in the heat developable light-sensitive material can be removed outside the system. Further, changes in the support form of the heat developable light-sensitive material caused by rapid heating thereof can also be inhibited.

Although the light-sensitive materials of the invention may be exposed by any methods, laser light is preferably used as an exposure light source. Preferred examples of the lasers used in the invention include a gas laser ($Ar^+$ or He—Ne), a YAG laser, a dye laser and a semiconductor laser. Further, a semiconductor laser and a second harmonic generating element can also be used in combination. Preferred is a red- to infrared-emitting gas laser or a semiconductor laser.

Laser imagers for medical application provided with exposure units and heat development units include a Fuji medical dry laser imager, FM-DP L. FM-DP L is described in *Fuji Medical Review,* No. 8, pages 39 to 55, and needless to say, this technique is applied as the laser imager for the heat developable light-sensitive material of the invention. Further, this can also be applied as the heat developable light-sensitive material for the laser imager in an "AD network" proposed by Fuji Medical System as a network system adapted to the DICOM standard.

The heat developable light-sensitive materials of the invention form black and white images according to silver images, and preferably used as heat developable light-sensitive materials for medical diagnosis, heat developable light-sensitive materials for industrial photography, heat developable light-sensitive materials for printing and heat developable light-sensitive materials for COM.

The invention will be described in more detail with reference to the following examples. Appropriate changes and modifications in the materials, reagents, ratios and operations shown in the following examples can be made without departing from the spirit of the invention. It is therefore to be understood that the invention is not limited to the specific examples shown below.

EXAMPLE 1

<Preparation of Polyethylene Terephthalate (PET) Support Having Undercoat Layer>

(Preparation of PET Support)

Using terephthalic acid and ethylene glycol, PET having an intrinsic viscosity of 0.66 (measured in phenol/tetrachloroethane (6/4 in weight ratio) at 25° C.) was obtained. This was pelletized, and then, dried at 130° C. for 4 hours. Then, this was melted at 300° C., and extruded through a T die, followed by rapid cooling to prepare an unoriented film having such a thickness as to give a film thickness of 175 μm after heat setting.

This unoriented film was oriented 3.3 times in a machine direction at 110° C. by use of rolls different from each other in peripheral speed, and then, oriented 4.5 times in a transverse direction at 130° C. with a tenter. After heat setting at 240° C. for 20 seconds, the oriented film was relaxed in a transverse direction by 4% at the same temperature. Then, after portions chucked with the tenter were slit off, the knurl treatment was applied to both edges. Then, the resulting film was taken up at a tension of 4 kg/cm$^2$ to obtain a roll of the PET support having a thickness of 175 μm.

(Surface Corona Treatment)

Both surfaces of the support were treated with a Model 6KVA solid state corona treating device manufactured by Pillar Co. at room temperature at 20 m/min. Readings of current and voltage at this time revealed that the support was treated at 0.375 kV·A·min./m$^2$. The treatment frequency at this time was 9.6 kHz, and the gap clearance between an electrode and a dielectric roll was 1.6 mm.

(Preparation of PET Support Having Undercoat Layer)

(1) Preparation of Coating Solutions for Undercoat Layers

| Formulation 1 of Coating Solution for Undercoat Layer (for Undercoat Layer on Light-Sensitive Layer Side) | |
|---|---|
| Pesresin A-515GB manufactured by Takamatsu Yushi Co. (a 30 wt % solution) | 234 g |
| Polyethylene glycol monononyl phenyl ether (average ethylene oxide number: 8.5, a 10 wt % solution) | 21.5 g |
| MP-1000 manufactured by Soken Chemical & Engineering Co., Ltd. (fine polymer particles, average particle size: 0.4 μm) | 0.91 g |
| Distilled water | 744 ml |
| **Formulation 2 of Coating Solution for Undercoat Layer (for First Layer on Back Face Side)** | |
| Butadiene-styrene copolymer latex (solid content: 40 wt %, styrene/butadiene weight ratio: 68/32) | 158 g |
| 2,4-Dichloro-6-hydroxy-S-triazine sodium salt (a 8 wt % aqueous solution) | 20 g |
| A 1 wt % aqueous solution of sodium laurylbenzene-sulfonate | 10 ml |
| Distilled water | 854 ml |
| **Formulation 3 of Coating Solution for Undercoat Layer (for Second Layer on Back Face Side)** | |
| $SnO_2$/SbO (weight ratio: 9/1, average particle size: 0.038 μm, a 17 wt % dispersion) | 84 g |
| Gelatin (a 10% aqueous solution) | 89.2 g |
| Metrose TC-5 manufactured by Shin-Etsu Chemical Co., Ltd. (a 2% aqueous solution) | 8.6 g |
| MP-1000 manufactured by Soken Chemical & Engineering Co., Ltd. | 0.01 g |
| A 1 wt % aqueous solution of sodium dodecylbenzene-sulfonate | 10 ml |
| NaOH (1 wt %) | 6 ml |
| Proxel (manufactured by I.C.I) | 1 ml |
| Distilled water | 805 ml |

(2) Preparation of PET Support Having Undercoat Layer

One face (image formation layer face) of the corona-treated PET support obtained above was coated with the above-mentioned formulation 1 of the coating solution for an undercoat layer with a wire bar so as to give a wet amount coated of 6.6 ml/m$^2$ (per one face), and dried at 180° C. for 5 minutes. Then, the back face thereof was coated with the above-mentioned formulation 2 of the coating solution for an undercoat layer with a wire bar so as to give a wet amount coated of 5.7 ml/m$^2$, and dried at 180° C. for 5 minutes. The back face was further coated with the above-mentioned formulation 3 of the coating solution for an undercoat layer with a wire bar so as to give a wet amount coated of 7.7 ml/m$^2$, and dried at 180° C. for 6 minutes. Thus, an undercoated support was prepared.

<Preparation of Back Face Coating Solutions>

(Preparation of Coating Solution for Antihalation Layer)

(1) Preparation of Fine Solid Particle Dispersion (a) of Base Precursor

Base precursor compound 11 given later (64 g), 28 g of diphenyl sulfone and 10 g of a surfactant, Demol N manufactured by Kao Corp. were mixed with 220 ml of distilled water, and the mixed solution was subjected to beads dispersion using a sand mill (a ¼ gallon sand grinder mill, manufactured by Eimex Co.) to obtain a fine solid particle dispersion (a) of the base precursor compound having an average particle size of 0.2 μm.

(2) Preparation of Fine Solid Particle Dispersion of Dye)

Cyanine dye compound 13 given later (9.6 g) and 5.8 g of sodium p-dodecylbenzenesulfonate were mixed with 305 ml of distilled water, and the mixed solution was subjected to beads dispersion using a sand mill (a ¼ gallon sand grinder mill, manufactured by Eimex Co.) to obtain a fine solid particle dispersion of the dye having an average particle size of 0.2 μm.

(3) Preparation of Coating Solution for Antihalation Layer)

Gelatin (17 g), 9.6 g of polyacrylamide, 70 g of the fine solid particle dispersion (a) of the base precursor obtained in the above (1), 56 g of the fine solid particle dispersion of the dye obtained in the above (2), 1.5 g of fine polymethyl methacrylate particles (average particle size: 6.5 μm), 0.03 g of benzoisothiazolinone, 2.2 g of sodium polyethylenesulfonate, 0.2 g of blue dye compound 14 given later, 3.9 g of yellow dye compound 15 given later and 844 ml of water were mixed to prepare a coating solution for an antihalation layer.

(Preparation of Coating Solution for Back Face Protective Layer)

A vessel was kept hot at 40° C., and 50 g of gelatin, 0.2 g of sodium polyethylenesulfonate, 2.4 g of N,N-ethylenebis (vinylsulfoneacetamide), 1 g of sodium t-octylphenoxyethoxyethanesulfonate, 30 mg of benzoisothiazolinone, 37 mg of N-perfluorooctylsulfonyl-N-propylalanine potassium salt, 0.15 g of polyethylene glycol mono(N-perfluorooctylsulfonyl-N-propyl-2-aminoethyl)ether (average degree of polymerization of ethylene oxide: 15) 32 mg of $C_8F_{17}SO_3K$, 64 mg of $C_8F_{17}SO_2N(C_3H_7)(CH_2CH_2O)_4(CH_2)_4—SO_3Na$, 8.8 g of acrylic acid/ethyl acrylate copolymer (copolymerization weight ratio: 5/95), 0.6 g of Aerosol OT (manufactured by American Cyanamide), 1.8 g of a fluid paraffin emulsion as fluid paraffin, and 950 ml of water were mixed therein to prepare a coating solution for a back face protective layer.

<Preparation of Mixed Silver Halide Emulsion A>

(1) Preparation of Silver Halide Emulsion 1

To 1421 ml of distilled water, 3.1 ml of a 1 wt % potassium bromide solution was added, and 3.5 ml of 0.5 mol/liter sulfuric acid and 31.7 g of gelatin phthalate were further added thereto. The resulting solution was maintained at 34° C. in a stainless steel reaction pot with stirring. On the other hand, solution A was prepared by diluting 22.22 g of silver nitrate with distilled water to 95.4 ml, and solution B was prepared by diluting 15.9 g of potassium bromide with distilled water to a volume of 97.4 ml. Solution A and solution B were wholly added at a constant flow rate for 45 seconds. Then, 10 ml of a 3.5 wt % aqueous solution of hydrogen peroxide was added, and 10.8 ml of a 10 wt % aqueous solution of benzimidazole was further added. Furthermore, solution C was prepared by diluting 51.86 g of silver nitrate with distilled water to 317.5 ml, and solution D was prepared by diluting 45.8 g of potassium bromide with distilled water to a volume of 400 ml. Solution C was wholly added at a constant flow rate for 20 minutes, and solution D was added by the control double jet method, while maintaining the pAg at 8.1. Then, potassium iridate (III) hexachloride was wholly added so as to give $1\times10^{-4}$ mol per mol of silver, 10 minutes after the start of addition of solution C and solution D. Further, 5 seconds after the termination of addition of solution C, an aqueous solution of potassium iron (II) hexacyanide was wholly added in an amount of $3\times10^{-4}$ mol per mol of silver. The pH was adjusted to 3.8 using 0.5 mol/liter sulfuric acid, and stirring was stopped, followed by sedimentation, desalting and washing. Then, the pH was adjusted to 5.9 with 1 mol/liter sodium hydroxide to prepare a silver halide dispersion having a pAg of 8.0.

The above-mentioned silver halide dispersion was maintained at 38° C. with stirring, and 5 ml of a 0.34 wt % methanol solution of 1,2-benzoisothiazoline-3-one was added thereto. After 40 minutes, a solution of spectral sensitizing dye A given later in methanol was added in an amount of $1\times10^{-3}$ mol per mol of silver, and after 1 minute, the temperature was elevated to 47° C. Twenty minutes after the temperature elevation, sodium benzenethiosulfonate was added in an amount of $7.6\times10^{-5}$ mol per mol of silver as a methanol solution, and after further 5 minutes, tellurium sensitizer B given later was added in an amount of $1.9\times10^{-4}$ mol per mol of silver as a methanol solution, followed by ripening for 91 minutes. Then, 1.3 ml of a 0.8 wt % solution of N,N'-dihydroxy-N"-diethylmelamine in methanol was added. After still further 4 minutes, 5-methyl-2-mercaptobenzimidazole was added in an amount of $3.7\times10^{-3}$ mol per mol of silver as a methanol solution, and 1-phenyl-2-heptyl-5-mercapto-1,3,4-trazole was added in an amount of $4.9\times10^{-3}$ mol per mol of silver as a methanol solution. Thus, silver halide emulsion 1 was prepared.

Grains in the resulting silver halide emulsion 1 were pure silver bromide grains having an average sphere corresponding diameter of 0.046 μm and a coefficient of variation of sphere corresponding diameters of 20%. The grain size was determined from an average of 1000 grains using an electron microscope. The {100} face ratio of the grains determined by the Kubelka-Munk method was 80%.

(2) Preparation of Silver Halide Emulsion 2

A silver halide dispersion was prepared in the same manner as with the preparation of silver halide emulsion 1 with the exception that the liquid temperature in forming the grains was changed from 34° C. to 49° C., the addition time of solution C was changed to 30 minutes, and potassium iron (II) hexacyanide was removed. Further, silver halide emulsion 2 was prepared in the same manner as with the preparation of silver halide emulsion 1 with the exception that the amount of spectral sensitizing dye A added was changed to $7.5\times10^{-4}$ mol per mol of silver, the amount of tellurium sensitizer B added was changed to $1.1\times10^{-4}$ mol per mol of silver, and the amount of 1-phenyl-2-heptyl-5-mercapto-1,3,4-triazole added was changed to $3.3\times10^{-3}$ mol per mol of silver. Emulsion grains of silver halide emulsion 2 were cubic pure silver bromide grains having an average sphere corresponding diameter of 0.080 μm and a coefficient of variation of sphere corresponding diameters of 20%.

(3) Preparation of Silver Halide Emulsion 3

A silver halide dispersion was prepared in the same manner as with the preparation of silver halide emulsion 1 with the exception that the liquid temperature in forming the grains was changed from 34° C. to 27° C. Further, silver halide emulsion 3 was prepared in the same manner as with the preparation of emulsion 1 with the exception that spectral sensitizing dye A was used as a solid dispersion (aqueous solution of gelatin), the amount thereof added was changed to $6\times10^{-3}$ mol per mol of silver, and the amount of tellurium sensitizer B added was changed to $5.2\times10^{-4}$ mol per mol of silver. Emulsion grains of silver halide emulsion 3 were cubic pure silver bromide grains having an average sphere corresponding diameter of 0.038 μm and a coefficient of variation of sphere corresponding diameters of 20%.

(4) Preparation of Mixed Silver Halide Emulsion A)

Silver halide emulsion 1 (70% by weight), 15% by weight of silver halide emulsion 2 and 15% by weight of silver halide emulsion 3 were mixed, and a 1 wt % aqueous solution of benzothiazolium iodide was added thereto in an amount of $7\times10^{-3}$ mol per mol of silver.

<Preparation of Fatty Acid Silver Salt (Silver Behenate) Dispersion>

Behenic acid (trade name: Edenor C22-85R manufactured by Henckel Co.) (87.6 kg), 423 liters of distilled water, 49.2 liters of a 5 N aqueous solution of NaOH and 120 liters of tert-butanol were mixed, and stirred at 75° C. for 1 hour to conduct the reaction, thereby obtaining a sodium behenate solution. Separately, 206.2 liters of an aqueous solution containing 40.4 kg of silver nitrate (pH 4.0) was prepared, and the temperature thereof was kept at 10° C. A reaction vessel in which 635 liters of distilled water and 30 liters of tert-butanol were placed was kept at a temperature of 30° C., and the sodium behenate solution previously prepared and the aqueous solution of silver nitrate were wholly added thereto at a constant flow rate for 62 minutes and 10 seconds and for 60 minutes, respectively. At this time, only the aqueous solution of silver nitrate was added for 7 minutes and 20 seconds after the start of addition of the aqueous solution of silver nitrate. Thereafter, addition of the sodium behenate solution was started, and only the sodium behenate solution was added for 9 minute and 30 seconds after addition of the aqueous solution of silver nitrate was completed. At this time, the temperature in the reaction vessel was adjusted to 30° C., and the temperature of the outside was controlled so that the liquid temperature was maintained constant. Further, a pipe of an addition system of the sodium behenate solution was insulated with steam trace, and the opening of a valve for steam was controlled so that the liquid temperature at an outlet of a tip of an addition nozzle became 75° C. Further, a pipe of an addition system of the aqueous solution of silver nitrate was insulated by circulating cool water in the outer space of a double pipe so that the liquid temperature was maintained constant. A position of adding the sodium behenate solution and a position of adding the aqueous solution of silver nitrate were arranged symmetrically centered on a stirring shaft, and adjusted to such a height that they did not come into contact with the reaction solution.

After addition of the sodium behenate solution was completed, the solution was allowed to stand with stirring at a temperature left as it was for 20 minutes, and then, the temperature was lowered to 25° C. Then, solid matter was filtered by suction filtration, and washed with water until a filtrate showed a conductivity of 30 pS/cm. Thus, a fatty acid silver salt was obtained. The resulting solid matter was not dried and stored as a wet cake.

The shape of the resulting silver behenate particles was evaluated taking electron photomicrographs. As a result, the silver behenate particles were scaly crystals having a of 0.14 μm, b of 0.4 μm and c of 0.6 μm in average, an average aspect ratio of 5.2, an average sphere corresponding diameter of 0.52 μm, and a coefficient of variation of sphere corresponding diameters of 15% (a, b and c are specified in this specification).

To a wet cake corresponding to 100 g of dried solid matter, 7.4 g of polyvinyl alcohol (trade name: PVA-217) and water were added to make the total weight 385 g, and the resulting mixture was preliminarily dispersed with a homomixer.

Then, the original fluid preliminarily dispersed was treated three times with a dispersing device (trade name: Microfluidizer M-110S-EE, manufactured by Microfluidex International Corporation, using a G10Z interaction chamber), adjusting its pressure to 1750 kg/cm$^2$. Thus, a dispersed product of silver behenate was obtained. For the cooling operation, coiled heat exchangers were each mounted in front of and behind the interaction chamber, and the temperature of a refrigerant was controlled thereby to set the dispersing temperature to 18° C.

<Preparation of Reducing Agent Dispersion>

To 10 kg of 1,1-bis(2-hydroxy-3,5-dimethylphenyl)-3,5,5-trimethylhexane and 10 kg of a 20 wt % aqueous solution of modified polyvinyl alcohol (Poval MP203, manufactured by Kuraray Co., Ltd.), 16 kg of water was added, and sufficiently mixed to prepare a slurry. This slurry was supplied with a diaphragm pump, and dispersed in a horizontal sand mill (UVM-2, manufactured by Eimex Co.) filled with zirconia beads having an average diameter of 0.5 mm for 3 hours and 30 minutes. Then, 0.2 g of benzoisothiazolinone sodium salt and water were added thereto so as to give a reducing agent concentration of 25% by weight, thus obtaining a reducing agent dispersion. Reducing agent particles contained in the reducing agent dispersion thus obtained had a median diameter of 0.42 μm and a maximum particle size of 2.0 μm or less. The resulting reducing agent dispersion was filtered through a polypropylene filter having a pore size of 10.0 μm to remove foreign materials such as dust, and then stored.

(Preparation of Mercapto Compound Dispersion)

To 5 kg of 1-phenyl-2-heptyl-5-mercapto-$1_1$3,4-triazole and 5 kg of a 20 wt % aqueous solution of modified polyvinyl alcohol (Poval MP203, manufactured by Kuraray Co., Ltd.), 8.3 kg of water was added, and sufficiently mixed to prepare a slurry. This slurry was pumped with a diaphragm pump, and dispersed in a horizontal sand mill (UVM-2, manufactured by Eimex Co.) filled with zirconia beads having an average diameter of 0.5 mm for 6 hours. Then, water was added thereto so as to give a mercapto compound concentration of 10% by weight, thus obtaining a mercapto compound dispersion. Mercapto compound particles contained in the mercapto compound dispersion thus obtained had a median diameter of 0.40 μm and a maximum particle size of 2.0 μm or less. The resulting mercapto compound dispersion was filtered through a polypropylene filter having a pore size of 10.0 μm to remove foreign materials such as dust, and then stored. The dispersion was further filtered again through a polypropylene filter having a pore size of 10 μm just before the use thereof.

<Preparation of Organic Polyhalogen Compound Dispersions>

(1) Preparation of Organic Polyhalogen Compound Dispersion 1)

To 5 kg of tribromomethylnaphthylsulfone and 2.5 kg of a 20 wt % aqueous solution of modified polyvinyl alcohol (Poval MP203, manufactured by Kuraray Co., Ltd.), 213 g of a 20 wt % aqueous solution of sodium triisopropylnaphthalenesulfonate and 10 kg of water were added, and sufficiently mixed to prepare a slurry. This slurry was pumped with a diaphragm pump, and dispersed in a horizontal sand mill (UVM-2, manufactured by Eimex Co.) filled with zirconia beads having an average diameter of 0.5 mm for 5 hours. Then, 0.2 g of benzoisothiazolinone sodium salt and water were added thereto so as to give an organic polyhalogen compound concentration of 20% by weight, thus obtaining an organic polyhalogen compound dispersion 1. Organic polyhalogen compound particles contained in the dispersion thus obtained had a median diameter of 0.36 μm and a maximum particle size of 2.0 μm or less. The resulting organic polyhalogen compound dispersion 1 was filtered through a polypropylene filter having a pore size of 3.0 μm to remove foreign materials such as dust, and then stored.

(2) Preparation of Organic Polyhalogen Compound Dispersion 2)

Organic polyhalogen compound dispersion 2 was prepared in the same manner as with organic polyhalogen compound dispersion 1 with the exception that 5 kg of tribromomethylnaphthylsulfone was substituted by 5 kg of tribromomethyl(4-(2,4,6-trimethylphenylsulfonyl)phenyl)-sulfone, and the organic polyhalogen compound was diluted so as to give a concentration of 25% by weight, followed by filtration. Organic polyhalogen compound particles contained in the dispersion thus obtained had a median diameter of 0.38 μm and a maximum particle size of 2.0 μm or less. The resulting organic polyhalogen compound dispersion 2 was filtered through a polypropylene filter having a pore size of 3.0 μm to remove foreign materials such as dust, and then stored.

(3) Preparation of Organic Polyhalogen Compound Dispersion 3

Organic polyhalogen compound dispersion 3 was prepared in the same manner as with organic polyhalogen compound dispersion 1 with the exception that 5 kg of tribromomethylnaphthylsulfone was substituted by 5 kg of tribromomethylphenylsulfone, the amount of the 20 wt % aqueous solution of MP203 was changed to 5 kg, and the organic polyhalogen compound was diluted so as to give a concentration of 26% by weight, followed by filtration. Organic polyhalogen compound particles contained in the dispersion thus obtained had a median diameter of 0.41 μm and a maximum particle size of 2.0 μm or less. The resulting organic polyhalogen compound dispersion 3 was filtered through a polypropylene filter having a pore size of 3.0 μm to remove foreign materials such as dust, and then stored. Further, the dispersion was kept at a temperature of 10° C. or less from storage to use.

<Preparation of Solution of Phthalazine Compound>

Modified polyvinyl alcohol MP203 manufactured by Kuraray Co., Ltd. (8 kg) was dissolved in 174.57 kg of water, and then, 3.15 kg of a 20 wt % aqueous solution of sodium triisopropylnaphthalenesulfonate and 14.28 kg of a 70 wt % aqueous solution of 6-isopropylphthalazine were added thereto, thereby preparing a 5 wt % solution of 6-isopropylphthalazine.

<Preparation of Pigment Dispersion>

Water (250 g) was added to 64 g of C.I. Pigment Blue 60 and 6.4 g of Demol N manufactured by Kao Corp., and sufficiently mixed to prepare a slurry. The slurry was placed in a vessel together with 800 g of zirconia beads having an average diameter of 0.5 mm, and dispersed with a dispersing device (a 1/4G sand grinder mill, manufactured by Eimex Co.) for 25 hours to obtain a pigment dispersion. Pigment particles contained in the pigment dispersion thus obtained had an average particle size of 0.21 μm.

<Preparation of 40 Wt % SBR Latex>

The following SER latex diluted ten times with distilled water was diluted and purified using a module for ultrafiltration (UF)-purification, FSO3-FC-FUYO3A1 (Daisen Membrane System Co.) until the ion conductivity reached 1.5 mS/cm. Then, Sandet-BL manufactured by Sanyo Chemical Industries, Ltd. was added thereto so as to give a content of 0.22% by weight. Further, NaOH and $NH_4OH$ were added so as to give a molar ratio of $Na^+$ions to $NH_4^+$ ions of 1:2.3, thereby adjusting the pH to 8.4. At this time, the latex concentration was 40% by weight.

(SBR Latex: Latex of -St(68)-Bu(29)-AA(3)-)

Average particle size: 0.1 μm, concentration: 45% by weight, equilibrium moisture content measured at 25° C. and 60% RE: 0.6% by weight, ion conductivity: 4.2 mS/cm (the ion conductivity was measured for a stock solution (40%) of the latex at 25° C. by use of a CM-30S conductivity meter manufactured by Toa Electronics Ltd.), and pH: 8.2.

<Preparation of Coating Solution for Image Formation Layer>

The pigment dispersion (1.1 g), 103 g of the fatty acid silver salt (silver behenate) dispersion, 5 g of the 20 wt % aqueous solution of polyvinyl alcohol PVA-205 (manufactured by Kuraray Co., Ltd.), 20 g of the reducing agent dispersion, 16.3 g of the dispersions of organic polyhalogen compounds 1, 2 and 3 in total at a weight ratio of 5:1:3, 6.2 g of the mercapto compound dispersion, 106 g of the SBR latex (Tg: 17° C.) and 18 ml of the phthalazine compound solution, which were all obtained above, were mixed. Immediately before coating, 10 g of mixed silver halide emulsion A was added, and sufficiently mixed with the mixture to prepare a coating solution for an image formation layer (light-sensitive layer). The resulting coating solution for the image formation layer was supplied to a coating die as such so as to give 70 ml/$m^2$.

The viscosity of the coating solution for the image formation layer was measured with a B type viscometer (No 1 rotor, 60 rpm) of Tokyo Keiki Co., Ltd., and it was 85 [mPa·s] at 40° C. Further, the viscosity of the coating solution at 25° C. measured using an RFS fluid spectrometer manufactured by Rheometric Far East Co. was 1500, 220, 70, 40 and 20 [mPas] at shear rates of 0.1, 1, 10, 100 and 1000 [l/sec.], respectively.

<Preparation of Coating Solution for Intermediate Layer on Image Formation Layer Side>

To 772 g of a 10 wt % aqueous solution of polyvinyl alcohol PVA-205 (manufactured by Kuraray Co., Ltd.), 5.3 g of the pigment dispersion obtained above and 226 g of a 27.5 wt % solution of methyl methacrylate/styrene/butyl acrylate/hydroxyethyl methacrylate/acrylic acid copolymer (copolymerization weight ratio: 64/9/20/5/2) latex, 2 ml of a 5 wt % aqueous solution of Aerosol OT (manufactured by American Cyanamide) and 10.5 ml of a 20 wt % aqueous solution of diammonium phthalate were added. Then, water was added to bring the total weight to 880 g. The resulting solution was adjusted to pH 7.5 with NaOH to prepare a coating solution for an intermediate layer on the image formation layer side, and supplied to a coating die so as to give 10 ml/$m^2$.

The viscosity of the coating solution for an intermediate layer measured with a B type viscometer (No. 1 rotor, 60 rpm) at 40° C. was 21 [mPa·s].

<Preparation of Coating Solution for First Protective Layer on Image Formation Layer Side>

Inert gelatin (64 g) was dissolved in water, and 80 g of a 27.5 wt % solution of methyl methacrylate/styrene/butyl acrylate/hydroxyethyl methacrylate/acrylic acid copolymer (copolymerization weight ratio: 64/9/20/5/2) latex, 23 ml of a 10 wt % solution of phthalic acid in methanol, 23 ml of a 10 wt % aqueous solution of 4-methylphthalic acid, 28 ml of sulfuric acid having a concentration of 0.5 mol/liter, 5 ml of a 5 wt % aqueous solution of Aerosol OT (manufactured by American Cyanamide), 0.5 g of phenoxyethanol and 0.1 g of benzoisothiazolinone were added thereto. Then, water was added thereto to bring the total weight to 750 g, thus preparing a coating solution for a first protective layer on the image formation layer side. Just before coating, 26 ml of 4 wt % chrome alum was added thereto and mixed in a static mixer. The resulting solution was supplied to a coating die so as to give 18.6 ml/$m^2$.

The viscosity of the coating solution for the first protective layer measured with a B type viscometer (No. 1 rotor, 60 rpm) at 40° C. was 17 [mPa·s].

<Preparation of Coating Solution for Second Protective Layer on Image Formation Layer Side>

Inert gelatin (80 g) was dissolved in water, and 102 g of a 27.5 wt % solution of methyl methacrylate/styrene/butyl acrylate/hydroxyethyl methacrylate/acrylic acid copolymer (copolymerization weight ratio: 64/9/20/5/2) latex, 3.2 ml of a 5 wt % solution of N-perfluorooctylsulfonyl-N-propylalanine potassium salt, 32 ml of a 2 wt % aqueous solution of polyethylene glycol mono(N-perfluorooctylsulfonyl-N-propyl-2-aminoethyl)ether (average degree of polymerization of ethylene oxide: 15), 23 ml of a 5 wt % solution of Aerosol OT (manufactured by American Cyanamide), 4 g of fine polymethyl methacrylate particles (average particle size: 0.7 μm), 21 g of fine polymethyl methacrylate particles (average particle size: 6.4 μm), 1.6 g of 4-methylphthalic acid, 4.8 g of phthalic acid, 44 ml of 0.5 mol/liter sulfuric acid and 10 mg of benzoisothiazolinone were added thereto. Then, water was added thereto to bring the total weight to 650 g, and the resulting solution was mixed with 445 ml of an aqueous solution containing 4% by weight of chrome alum and 0.67% by weight of phthalic acid in a static mixer just before coating to prepare a coating solution for a second protective layer on the image formation layer side, which was supplied to a coating die so as to give 8.3 ml/$m^2$.

The viscosity of the coating solution measured with a B type viscometer (No. 1 rotor, 60 rpm) at 40° C. was 9 [mPa·s].

<Preparation of Heat Developable Light-sensitive Material (Sample 001)>

The back face side of the above-mentioned undercoated support was simultaneously coated in multiple layers with the coating solution for the antihalation layer so as to give an amount of solid matter coated of the fine solid particle dye of 0.04 g/$m^2$ and with the coating solution for the back face protective layer thereon so as to give an amount of gelatin coated of 1.7 g/$m^2$, followed by drying to prepare a back layer.

Then, the emulsion layer (the amount of silver halide coated in terms of silver: 0.14 g/$m^2$), the intermediate layer, the first protective layer and the second protective layer were simultaneously coated in multiple layers on the side opposite to the back face in this order by the slide speed coating system to prepare heat developable light-sensitive material sample 001. The coating and drying conditions were as follows.

The coating was carried out at a speed of 160 m/min., and the clearance between a tip of the coating die and the support was set to 0.10 to 0.30 mm. The pressure in a vacuum chamber was set to a pressure 196 to 882 Pa lower than atmospheric pressure. Static was eliminated from the support by ionic air.

In a subsequent chilling zone, the coating solutions applied were cooled by air having a dry-bulb temperature of 10° C. to 20° C., followed by non-contact type transfer. Then, the sample was dried by dry air having a dry-bulb temperature of 23° C. to 45° C. and a wet-bulb temperature of 15° C. to 21° C. in a helical non-contact type drying apparatus.

After drying, the sample was subjected to moisture conditioning at 25° C. and 40% to 60% RE, and then, heated so that the temperature of the film surface was elevated to 70° C. to 90° C. After heating, the film surface was cooled to 25° C.

The matte degree of the heat developable light-sensitive material thus prepared was 550 seconds on the image formation layer side and 130 seconds on the back side, by the Beck smoothness. Further, measurement of the pH of the film surface on the light-sensitive layer side showed 6.0.

Spectral Sensitizing Dye A

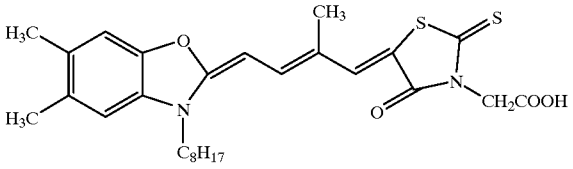

Tellurium Sensitizer B

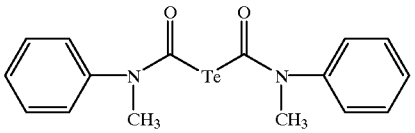

Base Precursor Compound 11

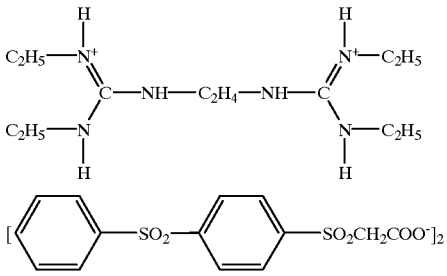

Cyanine Dye Compound 13

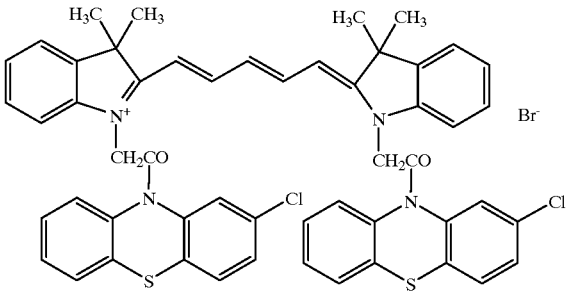

Blue Dye Compound 14

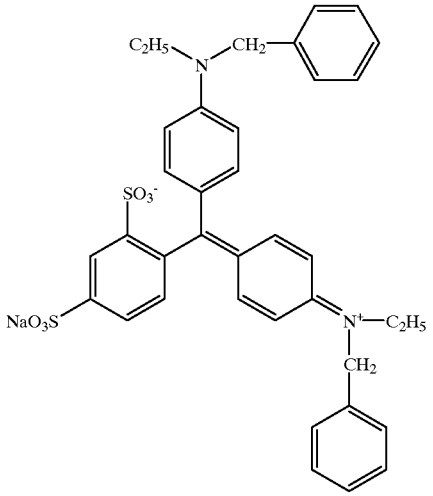

Yellow Dye Compound 15

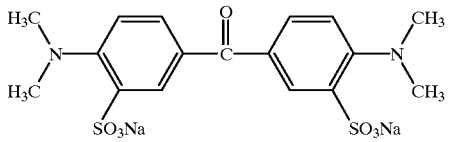

<Evaluation of Photographic Characteristics>

Using a Fuji medical dry laser imager FM-DPL (equipped with a 660-nm semiconductor laser having a maximum output of 60 mW (IIIB)), the photographic material prepared above was exposed and heat developed (at about 120° C.). The resulting image was evaluated with a densitometer.

Samples 002 to 020 were prepared in the same manner as with the above-mentioned heat developable light-sensitive material, sample 001 with the exception that the kind and amount of reducing agent represented by formula (I), aromatic carboxylic acid compound represented by formula (A) and hydrogen bonding compound represented by formula (II) were changed as shown in Table 1. The amount of each compound used was indicated by the relative molar percentage to the amount of the reducing agent of sample 001 used. Solid dispersions of the aromatic carboxylic acid compound represented by formula (A) and the hydrogen bonding compound represented by formula (II) were each prepared by the following methods, and added in specified amounts to the coating solution for the image formation layer.

<Preparation of 20% Dispersion of Compound Represented by Formula (A) of the Invention>

To 10 kg of the compound represented by formula (A) of the invention and 10 kg of a 20 wt % aqueous solution of modified polyvinyl alcohol (Poval MP203, manufactured by Kuraray Co., Ltd.), 16 kg of water was added, and sufficiently mixed to prepare a slurry. This slurry was supplied with a diaphragm pump, and dispersed in a horizontal sand mill (UVM-2, manufactured by Eimex Co.) filled with zirconia beads having an average diameter of 0.5 mm for 3 hours and 30 minutes. Then, 0.2 g of benzoisothiazolinone sodium salt and water were added thereto so that the concentration of the compound represented by formula (A) of the invention became 20% by weight, thus obtaining a dispersion. Additive particles contained in the dispersion thus obtained had a median diameter of 0.35 μm and a maximum particle size of 1.4 μm or less. The resulting dispersion was filtered through a polypropylene filter having a pore size of 10.0 μm to remove foreign materials such as dust, and then stored.

<Preparation of 20% Dispersion of Compound Represented by Formula (II) of the Invention>

To 10 kg of the compound represented by formula (II) of the invention and 10 kg of a 20 wt % aqueous solution of modified polyvinyl alcohol (Poval MP203, manufactured by Kuraray Co., Ltd.), 16 kg of water was added, and sufficiently mixed to prepare a slurry. This slurry was supplied with a diaphragm pump, and dispersed in a horizontal sand mill (UVM-2, manufactured by Eimex Co.) filled with zirconia beads having an average diameter of 0.5 mm for 3 hours and 30 minutes. Then, 0.2 g of benzoisothiazolinone sodium salt and water were added thereto so that the concentration of the compound represented by formula (II) of the invention became 20% by weight, thus obtaining a dispersion. Additive particles contained in the dispersion thus obtained had a median diameter of 0.42 μm and a maximum particle size of 1.6 μm or less. The resulting dispersion was filtered through a polypropylene filter having a pore size of 10.0 μm to remove foreign materials such as dust, and then stored.

These samples were subjected to laser exposure, and heat development was carried out by the above-mentioned method, followed by measurement of the maximum density (Dmax). Results thereof are shown in Table 1. Each sample was stored under the conditions of 60° C. and 50% RE for 3 days, and the fog density increased during the storage (ΔDmin) was measured. These values are also described in Table 1.

TABLE 1

| | Reducing Agent | | Aromatic Carboxylic Acid Compound | | Hydrogen Bonding Compound | | Image | | |
|---|---|---|---|---|---|---|---|---|---|
| Sample No. | Compound | Amount Used (mol %) | Compound | Amount Used (mol %) | Compound | Amount Used (mol %) | Image Density Dmax | Keeping Quality ΔDmin | Note |
| 001 | I-6 | 100 | — | — | — | — | 3.51 | 0.30 | Comparison |
| 002 | I-6 | 100 | A-8 | 15 | — | — | 3.92 | 0.52 | Comparison |
| 003 | I-6 | 100 | — | — | II-1 | 100 | 3.48 | 0.20 | Comparison |
| 004 | I-6 | 100 | A-8 | 15 | II-1 | 100 | 3.95 | 0.19 | Invention |
| 005 | I-14 | 60 | — | — | — | — | 3.63 | 0.43 | Comparison |
| 006 | I-14 | 60 | A-8 | 10 | — | — | 4.02 | 0.69 | Comparison |
| 007 | I-14 | 60 | — | — | II-1 | 65 | 3.59 | 0.24 | Comparison |

TABLE 1-continued

| Sample No. | Reducing Agent Compound | Reducing Agent Amount Used (mol %) | Aromatic Carboxylic Acid Compound Compound | Aromatic Carboxylic Acid Compound Amount Used (mol %) | Hydrogen Bonding Compound Compound | Hydrogen Bonding Compound Amount Used (mol %) | Image Image Density Dmax | Image Keeping Quality ΔDmin | Note |
|---|---|---|---|---|---|---|---|---|---|
| 008 | I-14 | 60 | A-8 | 10 | II-1 | 65 | 4.08 | 0.22 | Invention |
| 009 | I-14 | 60 | A-8 | 10 | II-2 | 65 | 4.06 | 0.21 | Invention |
| 010 | I-14 | 60 | A-8 | 10 | II-3 | 65 | 4.05 | 0.20 | Invention |
| 011 | I-14 | 60 | A-8 | 5 | II-6 | 65 | 3.95 | 0.16 | Invention |
| 012 | I-14 | 60 | A-8 | 10 | II-6 | 45 | 4.03 | 0.18 | Invention |
| 013 | I-14 | 60 | A-8 | 15 | II-6 | 45 | 4.01 | 0.20 | Invention |
| 014 | I-14 | 60 | A-8 | 20 | II-6 | 45 | 4.11 | 0.23 | Invention |
| 015 | I-14 | 60 | A-8 | 30 | II-6 | 45 | 4.15 | 0.22 | Invention |
| 016 | I-14 | 60 | A-2 | 10 | II-6 | 45 | 4.02 | 0.19 | Invention |
| 017 | I-14 | 60 | A-16 | 10 | II-6 | 45 | 4.05 | 0.20 | Invention |
| 018 | I-14 | 60 | A-27 | 10 | II-6 | 45 | 3.99 | 0.21 | Invention |
| 019 | I-11 | 60 | A-8 | 10 | II-6 | 45 | 4.11 | 0.25 | Invention |
| 020 | I-51 | 60 | A-8 | 10 | II-6 | 45 | 4.03 | 0.20 | Invention |

It is known from Table 1 that when the reducing agents represented by formula (I) were used in combination with the aromatic carboxylic acid compounds represented by formula (A), a great increase in sensitivity was obtained, but the image keeping quality was significantly deteriorated at the same time. However, it is found that the heat developable light-sensitive materials having high sensitivity could be obtained without deteriorating the image keeping quality by further using the hydrogen bonding compounds represented by formula (II) together therewith.

EXAMPLE 2

<Preparation of Dispersion of Reducing Agent Complex>

To 10 kg of a 1:1 complex of 2,2-methylenebis(4-ethyl-6-tert-butylphenol) and triphenylphosphine oxide and 10 kg of a 20 wt % aqueous solution of modified polyvinyl alcohol (Poval MP203, manufactured by Kuraray Co., Ltd.), 16 kg of water was added, and sufficiently mixed to prepare a slurry. This slurry was supplied with a diaphragm pump, and dispersed in a horizontal sand mill (UVM-2, manufactured by Eimex Co.) filled with zirconia beads having an average diameter of 0.5 mm for 3 hours and 30 minutes. Then, 0.2 g of benzoisothiazolinone sodium salt and water were added thereto so as to give a reducing agent concentration of 25% by weight, thus obtaining a reducing agent complex dispersion. Reducing agent complex particles contained in the reducing agent complex dispersion thus obtained had a median diameter of 0.46 μm and a maximum particle size of 2.0 μm or less. The resulting reducing agent complex dispersion was filtered through a polypropylene filter having a pore size of 10.0 μm to remove foreign materials such as dust, and then stored.

<Preparation of Organic Polyhalogen Compound Dispersion 4>

Organic polyhalogen compound dispersion 4 was prepared in the same manner as with the preparation of organic polyhalogen compound dispersion 1 in Example 1 with the exception that 5 kg of N-butyl-3-tribromomethanesulfonylbenzamide was substituted by 5 kg of tribromomethylnaphthylsulfone, and the organic polyhalogen compound was diluted so as to give a concentration of 25% by weight, followed by filtration Organic polyhalogen compound particles contained in the dispersion thus obtained had a median diameter of 0.41 μm and a maximum particle size of 2.0 μm or less. The resulting organic polyhalogen compound dispersion 4 was filtered through a polypropylene filter having a pore size of 3.0 μm to remove foreign materials such as dust, and then stored.

<Preparation of Coating Solution for Image Formation Layer>

A coating solution for an image formation layer was prepared in the same manner as with the preparation of the coating solution for the image formation layer in Example 1 with the exception that the reducing agent used in Example 1 was substituted by 21 g of the reducing agent complex obtained above, 8.2 g of a 1:3 (weight ratio) mixture of organic polyhalogen compound dispersion 3 obtained in Example 1 and organic polyhalogen compound dispersion 4 obtained above was used as the organic polyhalogen compound, and 106 g of a 40 wt % SBR latex (latex of -St(71)-Bu(26)-AA(3)-, Tg: 24° C.) purified by ultrafiltration (UF) and pH adjusted was used a the SBR latex. The resulting coating solution was supplied to a coating die as such so as to give 70 ml/m$^2$.

<Preparation of Heat Developable Light-Sensitive Material (Sample 101)>

A heat developable light-sensitive material (sample 101) was prepared in the same manner as with the preparation of the heat developable light-sensitive material (sample 001) in Example 1 with the exception that the coating solution for the image formation layer obtained above was used, and yellow dye compound 15 of the antihalation layer was eliminated.

Samples 102 to 116 were prepared in the same manner as with the above-mentioned heat developable light-sensitive material, sample 101, with the exception that the kind and amount of reducing agent complex and development accelerator used were changed as shown in Table 2. The amount of each compound used was indicated by the relative molar percentage to the amount of the reducing agent complex of sample 101 used.

These samples were evaluated in the same manner as with Example 1. Results thereof are shown together in Table 2.

TABLE 2

| Sample No. | Reducing Agent Compound | Reducing Agent Amount Used (mol %) | Aromatic Carboxylic Acid Compound Compound | Aromatic Carboxylic Acid Compound Amount Used (mol %) | Image Image Density Dmax | Image Keeping Quality ΔDmin | Note |
|---|---|---|---|---|---|---|---|
| 101 | C-1 | 100 | — | — | 3.62 | 0.11 | Comparison |
| 102 | C-1 | 100 | A-8 | 5 | 3.96 | 0.16 | Invention |
| 103 | C-1 | 100 | A-8 | 10 | 4.06 | 0.17 | Invention |
| 104 | C-1 | 100 | A-8 | 15 | 4.11 | 0.17 | Invention |
| 105 | C-1 | 100 | A-8 | 20 | 4.19 | 0.18 | Invention |
| 106 | C-1 | 100 | A-8 | 30 | 4.25 | 0.19 | Invention |
| 107 | C-1 | 100 | A-4 | 10 | 4.02 | 0.17 | Invention |
| 108 | C-1 | 100 | A-14 | 10 | 4.11 | 0.18 | Invention |
| 109 | C-1 | 100 | A-16 | 10 | 4.07 | 0.17 | Invention |
| 110 | C-1 | 100 | A-21 | 10 | 4.05 | 0.19 | Invention |
| 111 | C-2 | 100 | — | — | 3.58 | 0.16 | Comparison |
| 112 | C-2 | 100 | A-8 | 10 | 4.05 | 0.15 | Invention |
| 113 | C-3 | 100 | — | — | 3.55 | 0.14 | Comparison |
| 114 | C-3 | 100 | A-8 | 10 | 4.04 | 0.14 | Invention |
| 115 | C-4 | 100 | — | — | 3.61 | 0.18 | Comparison |
| 116 | C-4 | 100 | A-8 | 10 | 4.08 | 0.17 | Invention |

C-1 1:1 complex of I-14 and II-1
C-2 1:1 complex of I-14 and II-2
C-3 1:1 complex of I-14 and II-6
C-4 1:1 complex of I-26 and II-2

It is known from Table 2 that even when the reducing agents were used in the form of complexes with the hydrogen bonding compounds, the sensitivity could be increased without deteriorating the image keeping quality by using them in combination with the development accelerators represented by formula (A).

The heat developable light-sensitive materials of the invention are high in heat development activity, excellent in image keeping quality, high in sensitivity and rapidly developable.

While the invention has been described in detail and with reference to specific embodiments thereof, it will be apparent to one skilled in the art that various changes and modifications can be made therein without departing from the spirit and scope thereof.

What is claimed is:

1. A heat developable light-sensitive material comprising a support having provided on one side thereof a light-sensitive silver halide, a light-insensitive organic silver salt, a reducing agent for a silver ion and a binder, wherein said reducing agent is a compound represented by the following formula (I), and an aromatic carboxylic acid compound represented by the following formula (A) and a hydrogen bonding compound are further provided on the same side where said light-sensitive silver halide is provided, (I)

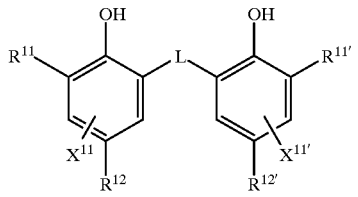

wherein $R^{11}$ and $R^{11'}$ each independently represents an alkyl group; $R^{12}$ and $R^{12'}$ each independently represents a hydrogen atom or a group substitutable to the benzene ring; $X^{11}$ and $X^{11'}$ each independently represents a hydrogen atom or a group substitutable to the benzene ring; $R^{11}$ and $X^{11}$, $R^{11'}$ and $X^{11'}$, $R^{12}$ and $X^{11}$, and $R^{12}$ and $X^{11'}$ may each combine with each other to form a ring; L represents a —S— group or a —$CHR^{13}$— group; and $R^{13}$ represents a hydrogen atom or an alkyl group, (A)

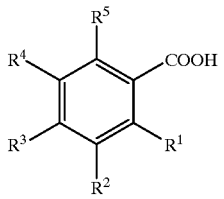

wherein $R^1$, $R^2$, $R^3$, $R^4$ and $R^5$ each independently represents a hydrogen atom or a group substitutable to the benzene ring, and wherein the compound of formula (A) has only one carboxyl group in its molecule; and at least one of $R^1$, $R^2$, $R^3$, $R^4$ and $R^5$ represents an undissociative substituent group linked by a carbon atom, a nitrogen atom, an oxygen atom, a sulfur atom or a phosphorus atom to the benzene ring.

2. The heat developable light-sensitive material according to claim 1, wherein said hydrogen bonding compound is a compound represented by the following formula (II):

(II)

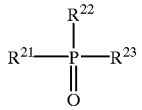

wherein $R^{21}$, $R^{22}$ and $R^{23}$, which may be unsubstituted or substituted, each independently represents an alkyl group, an aryl group, an alkoxyl group, an aryloxy group, an amino group or a heterocyclic group; and any two of $R^{21}$, $R^{22}$ and $R^{23}$ may combine with each other to form a ring.

3. The heat developable light-sensitive material according to claim 1, wherein at least one of $R^1$, $R^2$, $R^3$, $R^4$ and $R^5$ in said formula (A) is any one of an alkoxyl group, an aryloxy group, an acyloxy group, an alkylsulfonyloxy group, an arylsulfonyloxy group, an acyl group, an alkoxycarbonyl group and aryloxycarbonyl group.

4. The heat developable light-sensitive material according to claim 1, wherein in the compound represented by formula (I), $R^{11}$ and $R^{11'}$ are each independently a secondary or tertiary alkyl group, $R^{12}$ and $R^{12'}$ are each independently an alkyl group, L is a —S— group or a —$CHR^{13}$ group, wherein $R^{13}$ is a hydrogen atom or an alkyl group, and $X^{11}$ and $X^{11'}$ are both hydrogen atoms.

5. The heat developable light-sensitive material according to claim 4, wherein in the compound represented by formula (I), $R^{11}$ and $R^{11'}$ are each independently a tertiary alkyl group, $R^{12}$ and $R^{12'}$ are each independently an alkyl group, L is a —S— group or a —$CHR^{13}$ group, wherein $R^{13}$ is an alkyl group.

6. The heat developable light-sensitive material according to claim 4, wherein in the compound represented by formula (I), $R^{11}$ and $R^{11'}$ are each independently a tertiary alkyl group, $R^{12}$ and $R^{12}$ are each independently an alkyl group having two or more carbon atoms, L is a —S— group or a —$CHR^{13}$ group, wherein $R^{13}$ is a hydrogen atom.

7. The heat developable light-sensitive material according to claim 1, wherein said binder is an aqueous latex.

8. The heat developable light-sensitive material according to claim 7, wherein said binder has an average glass transition temperature of 20° C. to 60° C.

9. The heat developable light-sensitive material of claim 1, wherein said alkyl group of $R^{11}$ and $R^{11'}$ is substituted with a substituent, wherein said substituent is selected from the group consisting of an aryl group, a hydroxyl group, an alkoxyl group, an aryloxy group, an alkylthio group, an arylthio group, an acrylamino group, a sulfonamido group, a sulfonyl group, a phosphoryl group, an acyl group, a carbamoyl group, an ester group or a halogen atom.

10. The heat developable light-sensitive material of claim 1, wherein said reducing agent of formula (I) is added in the amount of 0.01 to 5.0 g/$m^2$.

11. The heat developable light-sensitive material of claim 1, wherein the heat developable light-sensitive material contains 5 to 50 mol % of said reducing agent of formula (I).

12. The heat developable light-sensitive material of claim 1, wherein the heat developable light-sensitive material contains 10 to 40 mol % of said reducing agent of formula (I).

13. The heat developable light-sensitive material of claim 1, wherein said aromatic carboxylic acid compound of formula (A) is added in the amount of 0.5 to 50 mol % based on the amount of said reducing agent.

14. The heat developable light-sensitive material of claim 1, wherein said aromatic carboxylic acid compound of formula (A) is added in the amount of 1.0 to 30 mol % based on the amount of said reducing agent.

15. The heat developable light-sensitive material of claim 1, wherein said hydrogen bonding compound is added in the amount of 10 to 150 mol % based on the amount of said reducing agent.

16. The heat developable light-sensitive material of claim 1, wherein said hydrogen bonding compound is added in the amount of 30 to 100 mol % based on the amount of said reducing agent.

17. The heat developable light-sensitive material of claim 1, wherein said light-insensitive organic silver salt is a silver salt of a long-chain aliphatic carboxylic acid having 15 to 28 carbon atoms.

18. The heat developable light-sensitive material of claim 1, wherein said light-insensitive organic silver salt is selected from the group consisting of silver behenate, silver arachidate, silver stearate, silver oleate, silver laurate, silver caproate, silver myristate, silver palmitate and mixtures thereof.

19. The heat developable light-sensitive material of claim 1, wherein said light-insensitive organic silver salt is scaly.

20. The heat developable light-sensitive material of claim 1, wherein said light sensitive silver halide comprises silver halide grains having a grain size of 0.20 $\mu$m or less, wherein the silver halide grains are of cubic form.

21. The heat developable light-sensitive material of claim 1, wherein said binder comprises a styrene-butadiene copolymer latex.

* * * * *